US005626281A

United States Patent [19]

Bloom

[11] Patent Number: 5,626,281

[45] Date of Patent: May 6, 1997

[54] FOLDED ENVELOPES, UNITARY BLANKS FOR FORMING FOLDED ENVELOPES AND METHODS FOR MANUFACTURING FOLDED ONE-PIECE ENVELOPES

[76] Inventor: Benjamin H. Bloom, 1103 Berwind Rd., Wynnewood, Pa. 19096

[21] Appl. No.: 188,138

[22] Filed: Jan. 26, 1994

[51] Int. Cl.[6] ..... B65D 27/14

[52] U.S. Cl. ..... 229/75; 229/82

[58] Field of Search ..... 229/75, 76, 82, 229/84, 308, 315, 80, 68.1

[56] References Cited

U.S. PATENT DOCUMENTS

| | | | |
|---|---|---|---|
| 179,351 | 6/1876 | Rogers | 229/75 |
| 592,444 | 10/1897 | Rathjen, Jr. | 229/80 |
| 602,411 | 4/1898 | Sigesmond | 229/84 |
| 717,279 | 12/1902 | Rittenhouse | 229/80 |
| 982,594 | 1/1911 | Griffin | 229/82 |
| 1,196,245 | 8/1916 | Knurck | 229/76 |
| 2,051,711 | 8/1936 | Heywood | 229/80 |
| 2,664,896 | 1/1954 | Reineman | 229/68.1 |
| 2,770,412 | 11/1956 | Ribacoff | 229/80 |
| 3,558,040 | 1/1971 | Krueger | 229/303 |
| 4,180,168 | 12/1979 | Hiersteiner | 229/302 |

FOREIGN PATENT DOCUMENTS

| | | | |
|---|---|---|---|
| 10086 | of 1894 | United Kingdom | 229/302 |
| 24528 | of 1907 | United Kingdom | 229/80 |
| 505518 | 5/1939 | United Kingdom | 229/80 |
| 640797 | 7/1950 | United Kingdom | 229/302 |

*Primary Examiner*—Stephen P. Garbe

[57] ABSTRACT

An envelope is formed from a scored blank. The blank is folded to form the envelope and comprises a sheet with score lines forming the boundary of a central portion which comprises a front of the envelope. A closure flap is hingedly connected to the remainder of the envelope along one of the score lines. A safety flap, also connected to the envelope along one of the score lines, is under the closure flap.

3 Claims, 20 Drawing Sheets

FOLDED ENVELOPES, UNITARY BLANKS FOR FORMING FOLDED ENVELOPES AND METHODS FOR MANUFACTURING FOLDED ONE-PIECE ENVELOPES

FIELD AND BACKGROUND OF THE INVENTION

This invention relates to folded envelopes and to blanks and methods for forming the same.

DESCRIPTION OF THE PRIOR ART

Folded envelopes of various types have been widely used heretofore. Examples of envelopes may be found in catalogs and publications of various stationery and trade business.

Patents relating to folded envelopes and to blanks for forming the same and appearing to be of most relevance to the patentability of the inventive subject matter disclosed and claimed in this patent application are U.S. Pat. Nos. 1,703,137, 1,741,456, 1,765,157, 1,928,180, 1,966,904, 2,007,178, 2,275,767, 2,356,066, 2,469,251, 3,236,440, 3,635,392, 3,756,504, 4,240,577, 4,727,988 and U.S. Pat. No. 4,765,485.

Other patents relating to folded envelopes and hence perhaps having some relevancy to the patentability of the subject matter disclosed herein are U.S. Pat. Nos. 1,715,177, 1,765,166, 1,944,020, 2,163,041, 2,224,604, 2,804,395, 3,758,025, 3,759,372, 3,788,539, 4,738,391 and Re 26,142.

Patents relating to other types of folders, cartons, wallets and other types of containers and hence possibly having some bearing on the patentability of the subject matter disclosed herein are U.S. Pat. Nos. 3,174,244, 3,237,327, 3,301,463, 3,679,122, 3,707,259, 3,720,304, 3,770,034, 3,966,113, 4,014,434, 4,534582, 4,655,388, 4,951,863, 4,971,195 and U.S. Pat. No. 4,982,845.

In order to be commercially viable, an envelope and blank must be easily handled by printing presses, dye cutting machines, folding machines and inserters. The envelope and blank should have a simple flexible format, being constructed from a flat sheet, typically paper, which is easily imprinted by a single press pass. Further, the envelope should be able to be formed from a blank that is cut, scored, folded and assembled with loose brochures, sheets, and other materials to be contained, sealed and mailed.

After receipt, the envelope should be openable without risk of tearing or otherwise damaging the contents. As an additional feature, the envelope, after opening should be capable of being used as a pouch for retaining the contents.

Automatic processing equipment typically used by large organizations to open envelopes may inadvertently open the bottom, rather than the top, of an envelope. Accordingly, it is desirable that an envelope include protection against inadvertent tearing of the contents placed inside the envelope from the process of opening the envelope from the bottom.

U.S. Pat. No. 4,349,107 to Pritchard relates to a blank purportedly adapted to be formed into a rectangular envelope, for holding circular meter charts. The Pritchard envelope includes a closure flap and a securing flap folded into the envelope. The securing flap is narrow and centered between side edges of the envelope.

U.S. Pat. No. 3,955,752 to Harrigan relates to a non-adhesively closed envelope comprising first and second panels and an inner and outer flap. The inner flap forms part of the second panel. The outer flap is positioned over the inner flap and includes a tuck member which may be inserted into an opening in the central portion of the inner flap.

U.S. Pat. No. 4,727,988 to Erickson relates to a cut and scored blank adapted to be folded for forming an envelope and an envelope formed therefrom.

OBJECTS OF THIS INVENTION

One object of this invention is to provide envelopes formed by folding unitary blanks of paper having safety flaps for preventing cutting of the contents of the envelopes when the envelopes are opened by conventional automated opening machinery.

It is another object of this invention to provide one-piece unitary blanks, which are imperforate, for forming such envelopes.

It is yet another object of this invention to provide methods for forming such envelopes, having such safety flaps, from such one-piece, imperforate unitary blanks.

It is yet another object of this invention to provide blanks which are easily handled using conventional equipment.

It is another object of this invention to provide envelopes for receiving and containing loose sheets, brochures and other materials for mailing and later for retention of such materials for storage after initial opening.

It is a further object of this invention to provide envelopes that protect the contents from damage during initial opening of the envelope.

SUMMARY OF THE INVENTION

In accordance with the above-recited objectives, the envelopes of the subject invention are formed from suitably scored blanks. The blanks are adapted to be folded for forming the envelopes.

In one aspect of the invention, a preferred version of the blank comprises a sheet of foldable material having score lines forming the boundary of a main body which comprises a front portion of the envelope. A closure flap extends horizontally and substantially co-extensively with the main body and is hingedly connected to the body along the upper one of said score lines. Right and left flap panels extend vertically of the main body and are hingedly connected thereto along the right and left score lines. The right and left flap panels are folded in juxtaposition with the main body to form the back portion of the envelope.

In such embodiment of the invention, the envelope also has a safety flap extending horizontally co-extensively with the main body and hingedly connected to an adjacent one of said body portions along the lower one of said score lines. The right and left flap panels each also include a flap portion extending vertically of and substantially co-extensively with each of the right and left flap panels. Accordingly, when the right and left flap panels are attached, the flap portions form a safety flap capable of being folded into the envelope to maintain the materials contained in the envelope and protect those materials from damage as the envelope is opened.

In another one of its multiple aspects, this invention provides a foldable blank for forming an envelope where the blank includes a sheet of material having linear scores of reduced strength therein to facilitate folding of the sheet therealong. The scores define a rectangular boundary of a central portion of the sheet forming a front of the envelope when folded. Portions of the sheets surrounding the rectangular boundary of the central portion may be of various shapes, according to the final construction of the envelope to be formed from the blank. One of the scores also defines one leg of a preferably triangularly bounded portion of the sheet outboard of the central portion. A second one of these scores, which is parallel with the first score, defines a boundary of a second preferably generally triangular portion of the sheet outboard of the central portion.

In yet another aspect of the invention, third and fourth ones of these scores are spaced from one another, extend between the second and first scores and respectively define boundaries of respective third and fourth preferably generally rectangular portions of the sheet which are outboard of the central portion. There are additionally fifth and sixth scores extending respectively from the third and fourth scores and defining additional boundaries of the third and fourth preferably generally rectangular portions of the sheet and also respective boundaries of respective first and second preferably triangular portions of the sheet. The third and fourth portions are respectively foldable along the third and fourth scores to form a rectangular back (which is substantially congruent with the front) of the envelope.

In such aspect of the invention, the preferably triangularly bounded portion of the sheet is foldable about the first score, which separates the central portion from the preferably triangularly bounded portion, to form a closure flap of the envelope. The first and second preferably triangular portions of the sheet are respectively foldable along the fifth and sixth scores to overlap the third and fourth preferably triangular portions and to form respective portions of a preferably triangular safety flap under the closure flap when the third and fourth portions are folded along these third and fourth scores to form the preferably rectangular back. The second preferably generally rectangular portion of the sheet is foldable about the second score to overlap the back of the envelope and to provide a closed bottom of the envelope after the third and fourth preferably generally rectangular portions have been respectively folded along the third and fourth scores to form the back of the envelope.

Still another aspect of the invention embraces various configurations of one-piece, imperforate blanks which are foldable along preferably entirely straight lines to form envelopes including safety flaps, inboard of a conventional closure flaps and substantially congruent with the envelope closure flaps. In this aspect of the invention, the blanks are defined by sheets of material having preferably straight line scores of reduced strength formed therein to facilitate folding of the blank therealong. Adjacent ones of these scores are transverse to one another. Some of the scores preferably define a rectangular boundary of a central portion of the blank forming a front of the envelope when folded. One score defining the preferably rectangular boundary also defines one leg of a preferably triangular boundary portion, outboard of the central portion of the blank. Third and fourth ones of the scores are spaced from one another, extend between first and second ones of the scores and respectively define boundaries of respective third and fourth preferably generally rectangular portions of the blank outboard of the central portion of the blank. Parallel fifth and sixth scores extend respectively from the third and fourth scores and define additional boundaries of the third and fourth preferably generally rectangular portions of the blank.

The invention yet further embraces various methods of foldably constructing one-piece envelopes including a safety flap, which is at least partially congruent with and under an envelope closure flap. Various methods may be used according to the form of the envelope to be produced and the form of the blank to be folded to produce the envelope. The methods may include cutting a sheet of preferably imperforate material to preselected size and shape defining an envelope blank. Straight line scores of reduced strength may be formed in the blanks to facilitate folding of the blanks therealong and may be further formed to define a rectangular boundary of a central portion of the blank forming a front of the envelope when folded. A first one of these scores may also define one leg of a triangular boundary portion of a preferably triangular closure flap adjoining the central portion of the blank along the first score bounding the central portion with the preferably triangular closure flap preferably being convergingly foldable towards the central portion along the first score. A second one of these scores parallel with the first score preferably additionally defines one boundary of a second preferably generally rectangular portion outboard of the central portion. This second preferably generally rectangular portion is preferably foldable along the second score to overlap a back of the envelope and to preferably provide a closed envelope bottom.

The third and fourth scores, when formed, are spaced from one another, extend between the first and second scores and respectively additionally define boundaries of respective third and fourth preferably generally rectangular portions of the envelope outboard of the central portion. These third and fourth generally rectangular portions are preferably convergingly foldable along the third and fourth scores towards a central portion to overlap the central portion and thereby form a back of the envelope.

In the blank when scored, there may further be included parallel fifth and sixth scores extending respectively from the third and fourth scores and defining additional boundaries of the third and fourth preferably generally rectangular portions.

The envelope is further formed by folding a second preferably generally rectangular portion of the blank towards the central portion along the second score which is parallel to and spaced from the first score. Next, two spaced apart preferably rectangular portions of the sheet connecting with the central portion along the spaced-apart third and fourth scores, running transversely to the first and second scores, are preferably convergingly folded respecting the central portion to overlap one another and form the back of the envelope.

In the methods a preferably triangular safety flap under the closure flap may be formed by folding the first and second preferably triangular portions of the sheet which adjoin the third and fourth preferably rectangular portions at said fifth and sixth scores, along said fifth and sixth scores, to overlap the third and fourth preferably rectangular portions when the first and second preferably triangular portions are convergingly folded towards said third and fourth preferably rectangular portions.

The safety flap under the closure flap is formed when (subsequent to folding of the first and second triangular portions along said fifth and sixth scores towards said third and fourth rectangular portions) the third and fourth preferably rectangular portions are convergingly folded along said third and fourth scores to form the back of the envelope. The second preferably rectangular portion is finally folded along the second score to overlap the back of the envelope and to provide a closed envelope bottom after the third and fourth generally rectangular portions have been respectively folded along said third and fourth scores to form said back.

The sequences of steps for folding the blanks to form the envelopes according to the invention may be altered according to the particular form of envelope desired to be produced from a given blank. Altering the sequence of steps may have the effect of reversing certain parts of the envelope, for example positioning a flap portion of the blank defining an envelope closed bottom inside or outside of other portions of the envelope blank forming the envelope back.

In preferred form the envelope may also contain closure and safety flaps attached to the top and bottom sides of the envelope. The main body is preferably rectangular but may be of other configurations.

Figure 1:
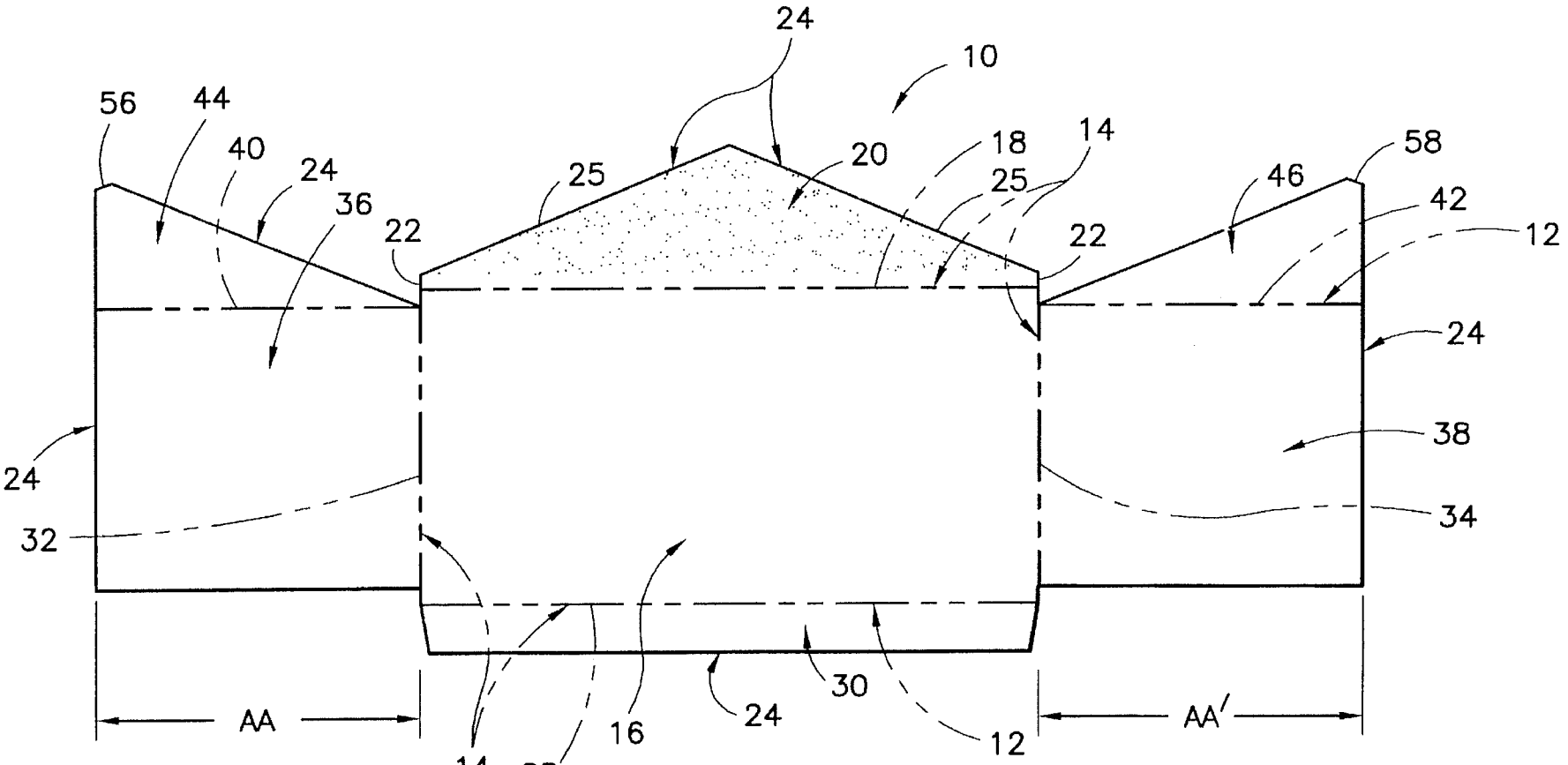
FIG. 1 is a plan view of a blank suitable for use in forming a first embodiment of an envelope in accordance with the invention; the blank illustrated in FIG. 1, the envelope formed therefrom and the method for forming such envelope all manifest aspects of the invention in its first and most preferred embodiment.

In the drawing figures, common drawing indicator numerals are used to identify structure which is substantially common (or has a substantial counterpart in) between or among two or more embodiments of the invention. Alphabetic subscripts are used to distinguish counterpart structures (which may be identical) used in the various embodiments.

DETAILED DESCRIPTION OF THE PREFERRED EMBODIMENTS AND BEST MODES KNOWN FOR PRACTICING THE INVENTION

A foldable blank for forming a first embodiment of an envelope 11 embodying aspects of the invention is illustrated in FIG. 1 and designated generally 10. Blank 10 is bounded and defined by edges designated generally 24.

Foldable blank 10 is preferably cut from a planar sheet of paper, cardboard or some other suitable rigid or semi-rigid material and has scores, which are preferably linear, of reduced strength formed therein to facilitate folding of blank 10 along these scores for forming envelope 11. The scores are designated generally 12 in FIG. 1; preferably edges 24 and scores 12 are straight, however, it is to be understood that this is not absolutely required. Adjacent ones of scores 12 are preferably transverse to one another. Scores designated generally 12 are schematically illustrated by a line consisting of long segments separated by two short segments.

Scores 12 are preferably formed by application of rollers, blades or some other relatively hard and relatively firm, optionally pointed implement to the blank. Preferably scores 12 are formed in blank 10 on a continuous and especially a production line basis by suitable scoring rollers. Similarly, blank 10 is preferably cut on a production line basis by suitable cutting rollers or other implements.

Some of scores 12 define a rectangular boundary, designated generally 14 in FIG. 1, of a central rectangular portion 16 of the material sheet from which blank 10 is formed. Central rectangular portion 16 of blank 10 forms a front of the envelope when blank 10 is folded into envelope 11. Scores 12 may be on either side or on both sides of blank 10 so long as a line or area of reduced strength, along which blank 10 can be folded, is formed in blank 10 for each indicated one of scores 12.

A first one of scores 12, designated 18 in FIG. 1, also defines a boundary of a first triangular portion 20 of blank 10 which adjoins central rectangular portion 16. First triangular portion 20 is preferably in the form of substantially an isosceles triangle. First triangular portion 20 is generally referred to herein as being generally "triangular", notwithstanding presence of edge portions 22 which are generally substantially perpendicular to first score 18 and connect specific ones of edges 24 of blank 10, specifically edges 25 of triangular portion 20, with first score 18.

The shapes of the parts of the blank 10 used to form envelope 11 as described herein, e.g. triangles and rectangles, while preferred, are not required. Also, the "front" and "back" of the envelope can be reversed from the configurations illustrated in the drawings.

Edge portions 22 are of substantially less length than are edges 25 with which respective edge portions 22 intersect.

Shading on triangular portion 20 denotes adhesive in FIGS. 1 through 4. This adhesive is preferably of the type that when moistened and the portion of the envelope blank bearing the adhesive is pressed against the second portion of the envelope blank as the portion bearing such adhesive is convergingly folded to facingly contact the second portion, the two portions of the blank are secured together once the adhesive dries.

A second score 28 is preferably generally parallel with first score 18 and additionally defines a boundary of a second generally rectangular portion 30 of blank 10 which adjoins central rectangular portion 16 along the length of second score 28.

Third and fourth scores which are respectively designated 32 and 34 in FIG. 1 are spaced from one another, extend between first and second scores 18, 28 and respectively define inboard boundaries of respective third and fourth generally rectangular portions 36, 38 of blank 10, where rectangular portions 36, 38 join central portion 16.

Still referring to FIG. 1, parallel fifth and sixth scores 40, 42 extend transversely respectively from third score 32 and fourth score 34 in directions parallel with first and second scores 18, 28. Scores 40, 42 respectively define additional boundaries of third and fourth generally rectangular portions 36, 38 of blank 10, and further respectively define inboard boundaries of respective second and third preferably generally triangular portions 44, 46 of blank 10.

Figure 2:
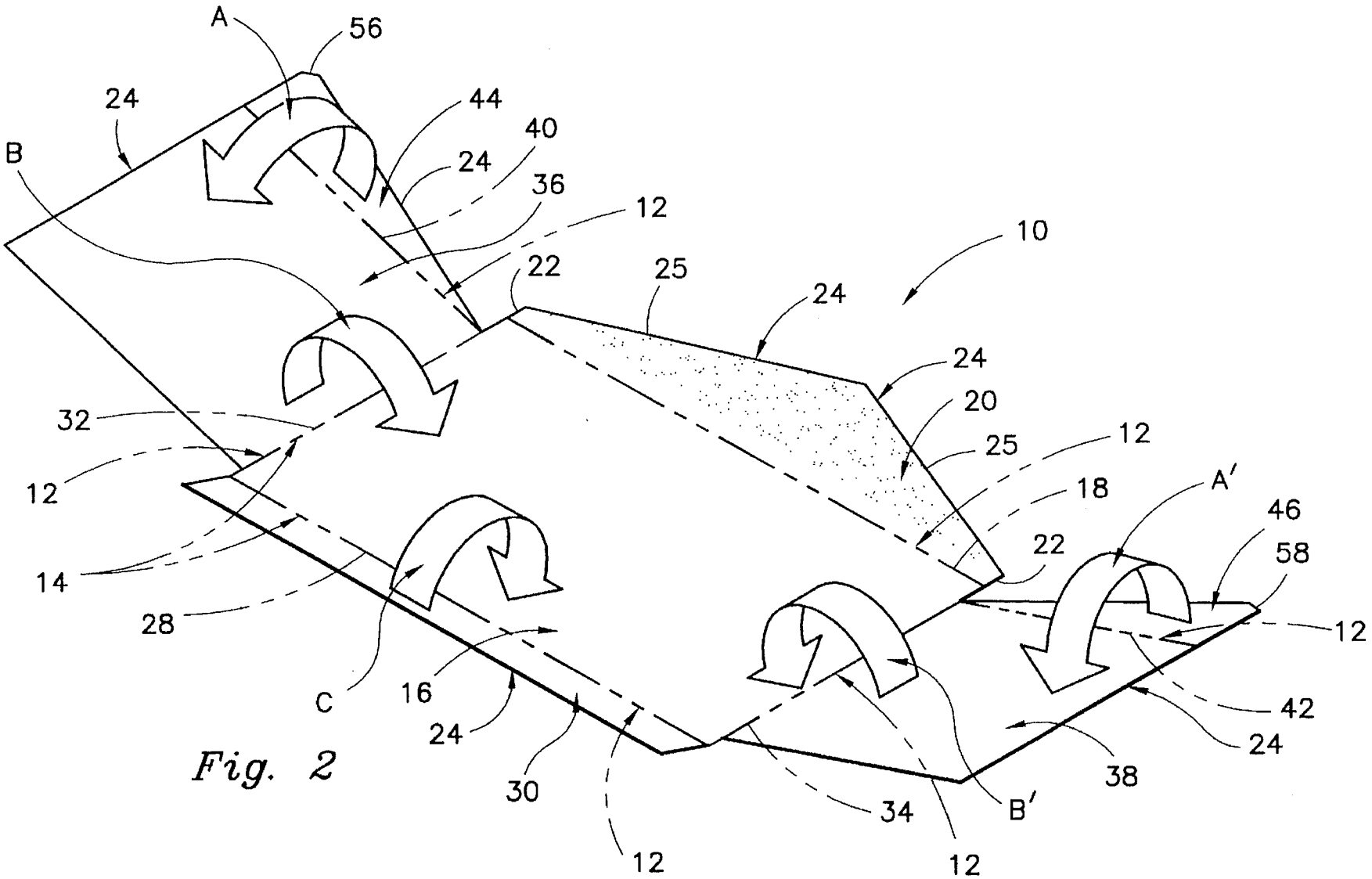
FIG. 2 is a schematic isometric view showing the blank illustrated in FIG. 1 being folded, in the process of forming an envelope according to the first embodiment of the invention.
Figure 3:
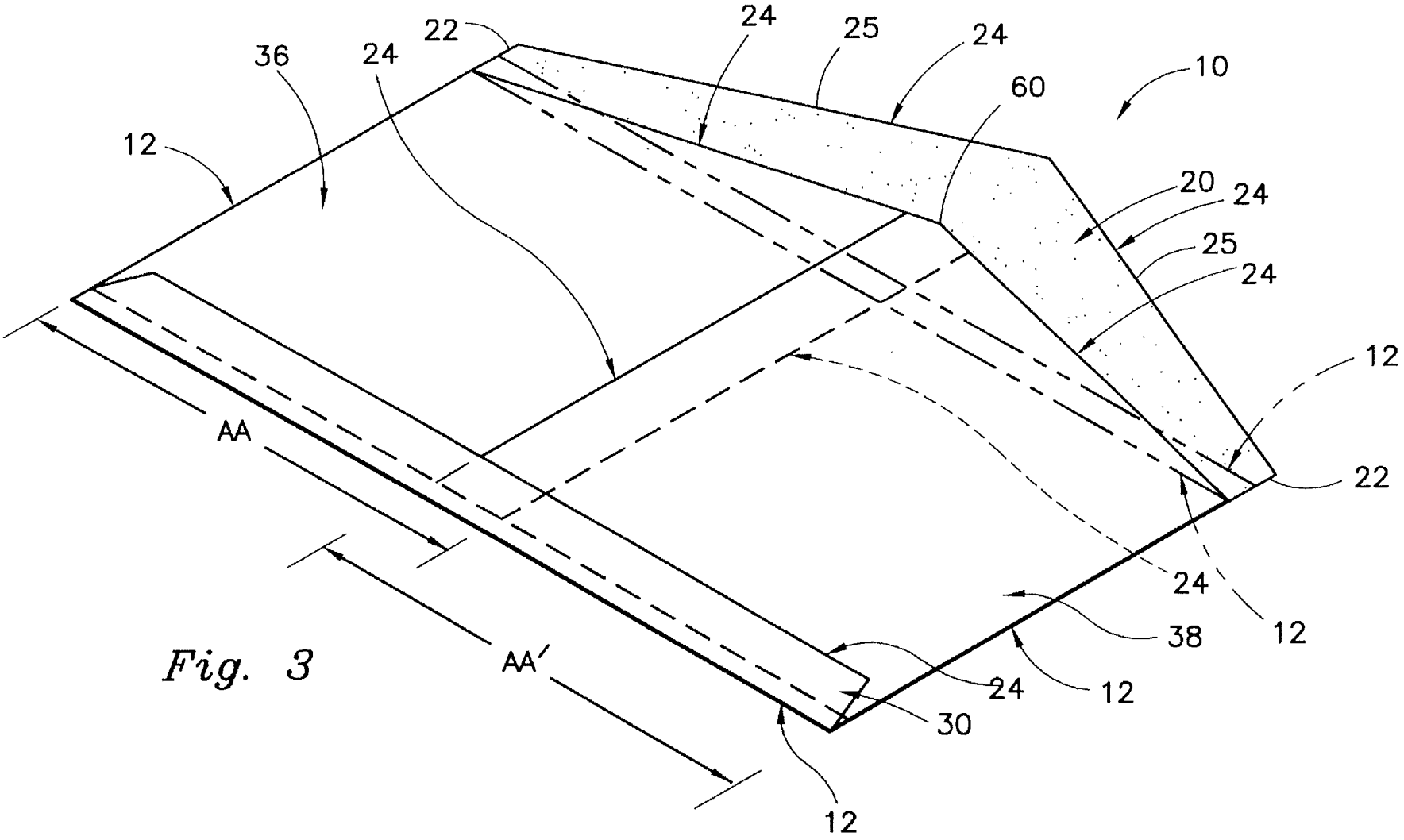
FIG. 3 is a view similar to FIG. 2 showing the blank further folded relative to FIGS. 1 and 2 in the process of forming an envelope according to the first embodiment of the invention.
Figure 4:
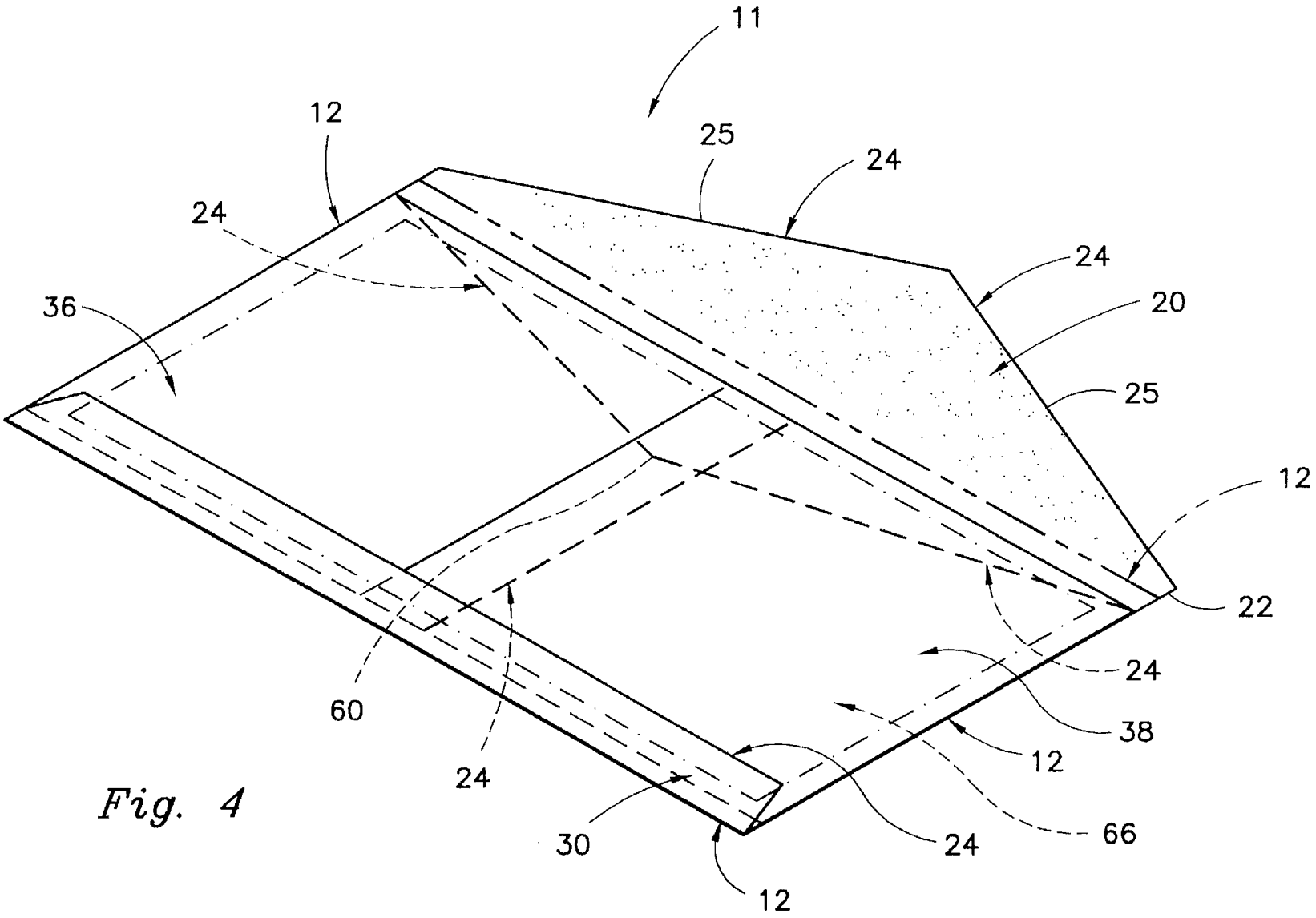
FIG. 4 is a view similar to FIGS. 2 and 3, showing the safety flap having been folded relative to the position illustrated in FIG. 3 in the process of forming an envelope according to the first embodiment of the invention, with the envelope ready for final sealing and a paper sheet contained within the envelope.

The folding procedure applied to foldable blank 10 to produce a first embodiment of an envelope 11 embodying aspects of the invention is manifest from FIGS. 2, 3 and 4, illustrating blank 10 being folded to form envelope 11 in one preferred procedure according to the invention.

Figure 5:
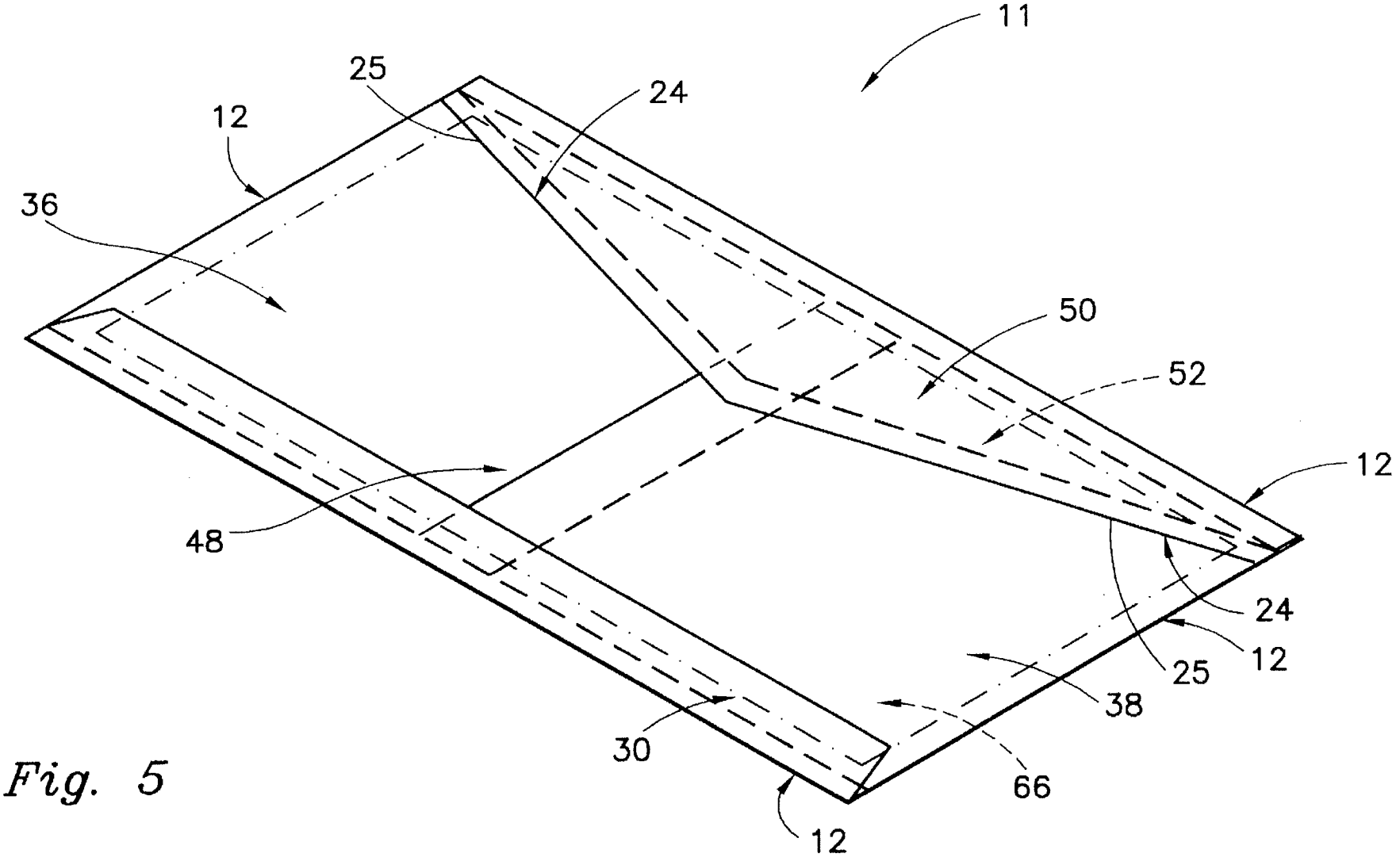
FIG. 5 is a view similar to FIGS. 2, 3 and 4 showing the blank folded to form an envelope according to the first embodiment of the invention, with the envelope containing a paper sheet and sealed for transmittal.

From FIGS. 2 and 3 especially it is apparent that third and fourth rectangular portions 36, 38 are respectively foldable, and are so-folded, along third and fourth scores 32, 34 to form a rectangular back 48 of envelope 11. Back 48 is preferably substantially congruent with central portion 16 forming a front of envelope 11. It is similarly apparent from FIGS. 2 through 4 that first triangular portion 20 of blank 10 is foldable, and is so-folded, along first score 18, which separates central rectangular portion 16 from first triangular portion 20, to form a closure flap 50 of envelope 11, as illustrated in FIG. 5.

It is yet further apparent from FIGS. 2 through 4 that second and third triangular portions 44, 46 of blank 10 are respectively foldable, and are so-folded, along fifth and sixth scores 40, 42 to overlap third and fourth rectangular portions 36, 38 respectively. As a result of such folding of second and third triangular portions 44, 46, these portions form respective portions of a preferably generally triangular safety flap 52. This safety flap is preferably under closure flap 50 when third and fourth rectangular portions 36, 38 are convergingly folded along third and fourth scores 32, 34 to form envelope back 48, with the construction and configuration of envelope 11 as shown in FIG. 5 resulting.

As is yet further apparent from FIGS. 2 through 4, second generally rectangular portion 30 of blank 10 is foldable, and is so-folded, along second score 28 to partially overlap envelope back 48 formed by third and fourth rectangular portions 36, 38. This provides a closed envelope bottom 54 after third and fourth generally rectangular portions 36, 38 have been respectively folded along third and fourth scores 32, 34 to form envelope back 48 which is preferably of rectangular configuration.

The sequence of folding of second generally rectangular portion 30 vis-a-vis third and fourth rectangular portions 36, 38 may be reversed. In such case, the closed bottom of the envelope formed by rectangular portion 30 lies within third and fourth rectangular portions 36, 38 with these rectangular portions overlying such closed envelope bottom defined by second rectangular portion 30.

Respecting the sequence of folding of blank 10 to produce envelope 11, it is most desirable that the initial folds be performed along scores 40, 42 by folding second and third triangular portions 44, 46 respectively towards third and fourth rectangular portions 36, 38 along folds 40, 42; this is illustrated by arrows A, A' in FIG. 2.

Once these folding steps have been completed, it is desirable that the combination of third rectangular portion 36 and second triangular portion 44 be folded convergingly towards central rectangular portion 16 along third score 32 as indicated by arrow B in FIG. 2. Once this folding step has been completed, it is desirable that the combination of third triangular portion 46 and fourth rectangular portion 48 be folded convergingly towards central rectangular portion 16 along fourth score 34 in the manner indicated generally by arrow B' in FIG. 2.

After this sequence of folds has been completed, fourth rectangular portion 38 somewhat overlaps third rectangular portion 36 as best illustrated in FIG. 4; a corresponding edge portion of third triangular portion 46 overlaps a similar edge portion of second triangular portion 44 as illustrated in FIG. 4. Next, second rectangular portion 30 is preferably convergingly folded towards third and fourth rectangular portions 36, 38 which now overlap central rectangular portion 16. This fold is made along score 28 in the manner indicated by arrow C in FIG. 2.

If this sequence of folds is followed, the envelope illustrated in FIG. 4 is formed.

Optionally, and equally desirably respecting the embodiment of the invention illustrated in FIGS. 1 through 5, the sequence of folds may be altered with the initial folds being of third and fourth rectangular portions 36, 38 respectively convergingly towards central rectangular portion 16 along third and fourth scores 32, 34 as illustrated by arrows B, B' in FIG. 2. Next, second rectangular portion 30 may be convergingly folded towards now overlying third and fourth rectangular portions 36, 38, with such fold being made along second score 28 as illustrated generally by arrow C in FIG. 2. If this sequence of folds is adopted, the result is to produce an envelope generally of the configuration illustrated in FIG. 3 but where the safety flap defined by second and third triangular portions 44, 46 remains outside the envelope, where it can be folded over the envelope contents to protect those contents from being inadvertently cut when the envelope is opened. In such case, the resulting safety flap 52 may be folded inwardly over the envelope contents, at the convenience of the envelope user.

In much the same manner of first triangular portion 20 and edge portions 22 as discussed above, it is to be noted respecting second and third triangular portions 44, 46 illustrated in FIG. 1 that while these portions have been referred to as being "triangular" (in that these portions are substantially triangular in configuration and appearance), these portions actually have, and have been illustrated with, four sides. Specifically, short edges 56, 58 have been illustrated connecting unnumbered sides of respective second and third triangular portions 44, 46, where short edges 56, 58 represent an edge which has been cut to eliminate what would otherwise be two vertices or points on closure flap 50 formed by second and third triangular portions 44, 46.

Blank 10 is cut so that horizontal dimensions AA, AA' of respective third and fourth rectangular portions 36, 38 are sufficient that some overlap results-at least a portion of third rectangular portion 36 overlaps a portion of fourth rectangular portion 38. Similarly, a portion of second triangular portion 44 overlaps third triangular portion 46. This overlap is clearly shown in FIGS. 3, 4, and 5 and may be desirable to provide strength in resulting envelope 11. Strength may result from provision of adequate surface area for application of adhesive, if desired, to retain in bonded-together disposition the overlapping strips (which have not been numbered in FIGS. 3, 4 and 5) of third and fourth rectangular portions 36, 38 and second and third triangular portions 44, 46.

Similarly, adhesive may be applied in the region of overlap of second rectangular portion 30 vis-a-vis third and fourth rectangular portions 36, 38 to secure the envelope in its assembled disposition.

Dimensions AA and AA' may be equal, but this is not required. Dimensions AA and AA' are preferably selected so that the area of overlap between rectangular portions 36 and 38 as illustrated in FIGS. 3 and 5, preferably has dimensions so that between about five percent and ten percent of the total width of the envelope is encompassed by the overlap of rectangular portions 36 and 38.

Short edges 56, 58 are provided as parts of the boundaries of second and third triangular portions 44, 46. As a result, when third and fourth rectangular portions 36, 38 are folded convergingly (respecting central rectangular portion 16) to provide overlap of a strip of third rectangular portion 36 and adjoining second triangular portion 44 (with a counterpart strip of fourth rectangular portion 38 and adjoining third triangular portion 46) a vertex 60 results. Vertex 60 is at the juncture of respective short edges 56, 58, where those edges overlap respective longer outboard edges 62, 64 of respective counterpart triangular portions 44 and 46 respectively.

In FIGS. 4 and 5, a sheet of paper 66 has been illustrated within envelope 11. The edge of paper sheet 66 which is most proximate to envelope closure flap 50 is preferably covered by safety flap 52. This edge of paper sheet 66 lies proximate fifth and sixth scores 40, 42 and separates safety flap 52 from the portion of envelope back 48 which safety flap 52 otherwise facingly contacts if safety flap 52 is folded into the interior of envelope 11, as illustrated generally in FIGS. 4 and 5.

Figure 6:
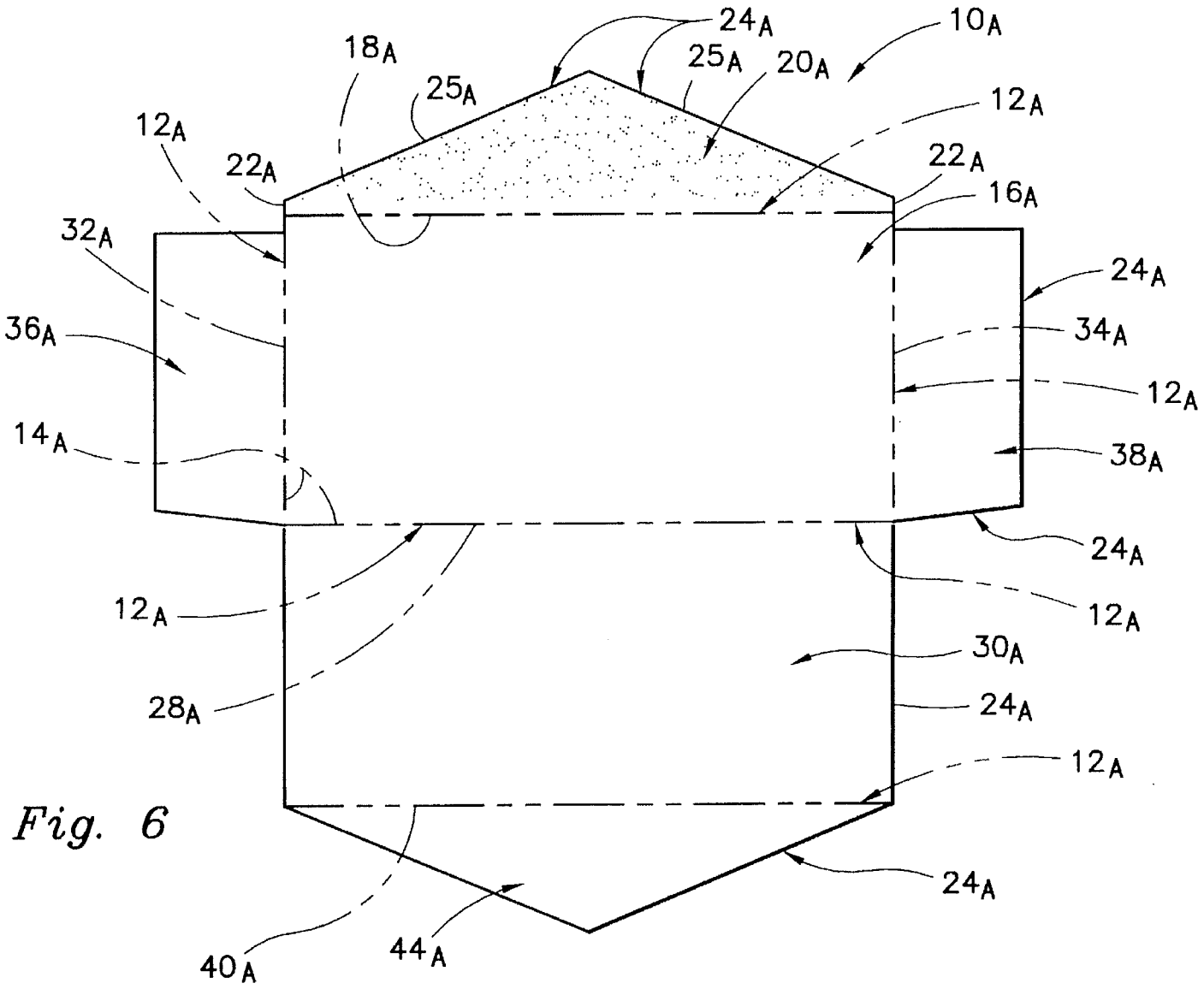
FIG. 6 is a plan view of a blank suitable for use in forming a second embodiment of an envelope in accordance with the invention; the blank illustrated in FIG. 6, the envelope formed therefrom and the method for forming such envelope all manifest aspects of the invention in its preferred second embodiment.

A foldable blank for forming a second embodiment of an envelope $\mathbf{11}_A$ embodying aspects of the invention is illustrated in FIG. 6 and designated generally $\mathbf{10}_A$. Blank $\mathbf{10}_A$ is bounded and defined by edges designated generally $\mathbf{24}_A$.

As with the embodiments of the invention illustrated in FIGS. 1 through 5, foldable blank $\mathbf{10}_A$ has scores, which are preferably linear, of reduced strength formed therein to facilitate folding of blank $\mathbf{10}_A$ along these scores. The scores are designated generally $\mathbf{12}_A$ in FIG. 6. Adjacent ones of scores $\mathbf{12}_A$ are preferably transverse to one another. Scores designated generally $\mathbf{12}_A$ are schematically illustrated by a line consisting of long segments separated by two short segments.

Scores $\mathbf{12}_A$ are preferably formed by application of rollers, blades or some other relatively hard and relatively firm, optionally pointed, implement to the blank. Preferably scores $\mathbf{12}_A$ are formed in blank $\mathbf{10}_A$ on a continuous and especially a production line basis by suitable scoring rollers. Similarly, blank $\mathbf{10}_A$ is preferably cut on a production line basis by suitable cutting rollers or other implements.

Some of scores $\mathbf{12}_A$ define a rectangular boundary, designated generally $\mathbf{14}_A$ in FIG. 6, of a central rectangular portion $\mathbf{16}_A$ of the material sheet from which blank $\mathbf{10}_A$ is formed. Central rectangular portion $\mathbf{16}_A$ of blank $\mathbf{10}_A$ forms a front of the envelope when blank $\mathbf{10}_A$ has been folded into envelope $\mathbf{11}_A$. Scores $\mathbf{12}_A$ may be on either side or on both sides of blank $\mathbf{10}_A$ so long as a line or area of reduced strength, along which blank $\mathbf{10}_A$ can be folded, is formed in blank $\mathbf{10}_A$ for each indicated one of scores $\mathbf{12}_A$.

A first one of scores $\mathbf{12}_A$, designated $\mathbf{18}_A$ in FIG. 6, also defines a boundary of a first triangular portion $\mathbf{20}_A$ of blank $\mathbf{10}_A$ which adjoins central rectangular portion $\mathbf{16}_A$. First triangular portion $\mathbf{20}_A$ is preferably in the form of substantially an isosceles triangle. As with the counterpart structure illustrated in FIGS. 1 through 5 respecting the first embodiment, first triangular portion $\mathbf{20}_A$ is generally referred to herein as being generally "triangular", notwithstanding presence of edge portions $\mathbf{22}_A$ which are generally substantially perpendicular to first score $\mathbf{18}_A$ and connect specific ones of edges $\mathbf{24}_A$ of blank $\mathbf{10}_A$, specifically edges $\mathbf{25}_A$ of triangular portion $\mathbf{20}_A$, with first score $\mathbf{18}_A$. Edge portions $\mathbf{22}_A$ are of substantially less length than are edges $\mathbf{25}_A$ with which respective edge portions $\mathbf{22}_A$ intersect.

The shapes of the parts of the blank $\mathbf{10}_A$ used to form envelope $\mathbf{11}_A$ as described herein, e.g. triangles and rectangles and trapezoids, while preferred, are not required. Also, the "front" and "back" of the envelope can be reversed from the configurations illustrated in the drawings.

In FIGS. 6 through 9, shading on triangular portion $\mathbf{20}_A$ denotes adhesive. This adhesive is preferably of the type that when moistened and the portion of the envelope blank bearing the adhesive is pressed against a second portion of the envelope blank as the portion bearing such adhesive is convergingly folded to facingly contact the second portion, the two portions of the blank are secured together once the adhesive dries.

A second score $\mathbf{28}_A$ is preferably generally parallel with first score $\mathbf{18}_A$ and additionally defines a boundary of a second generally rectangular portion $\mathbf{30}_A$ of blank $\mathbf{10}_A$ which adjoins central rectangular portion $16_A$ along the length of second score $28_A$.

Third and fourth scores, which are respectively designated $32_A$ and $34_A$ in FIG. 6, are spaced from one another, extend between first and second scores $18_A$, $28_A$ and respectively define inboard boundaries of respective first and second generally trapezoidal portions $36_A$, $38_A$ of blank $10_A$, where trapezoiodal portions $36_A$, $38_A$ join central portion $16_A$.

A fifth score $40_A$ defines another boundary of second generally rectangular portion $30_A$ of blank $10_A$ and separates second generally rectangular portion $30_A$ of blank $10_A$ from a second triangular portion $44_A$. Fifth score $40_A$ is preferably parallel with first and second scores $18_A$, $28_A$ as illustrated in FIG. 6.

Figure 7:
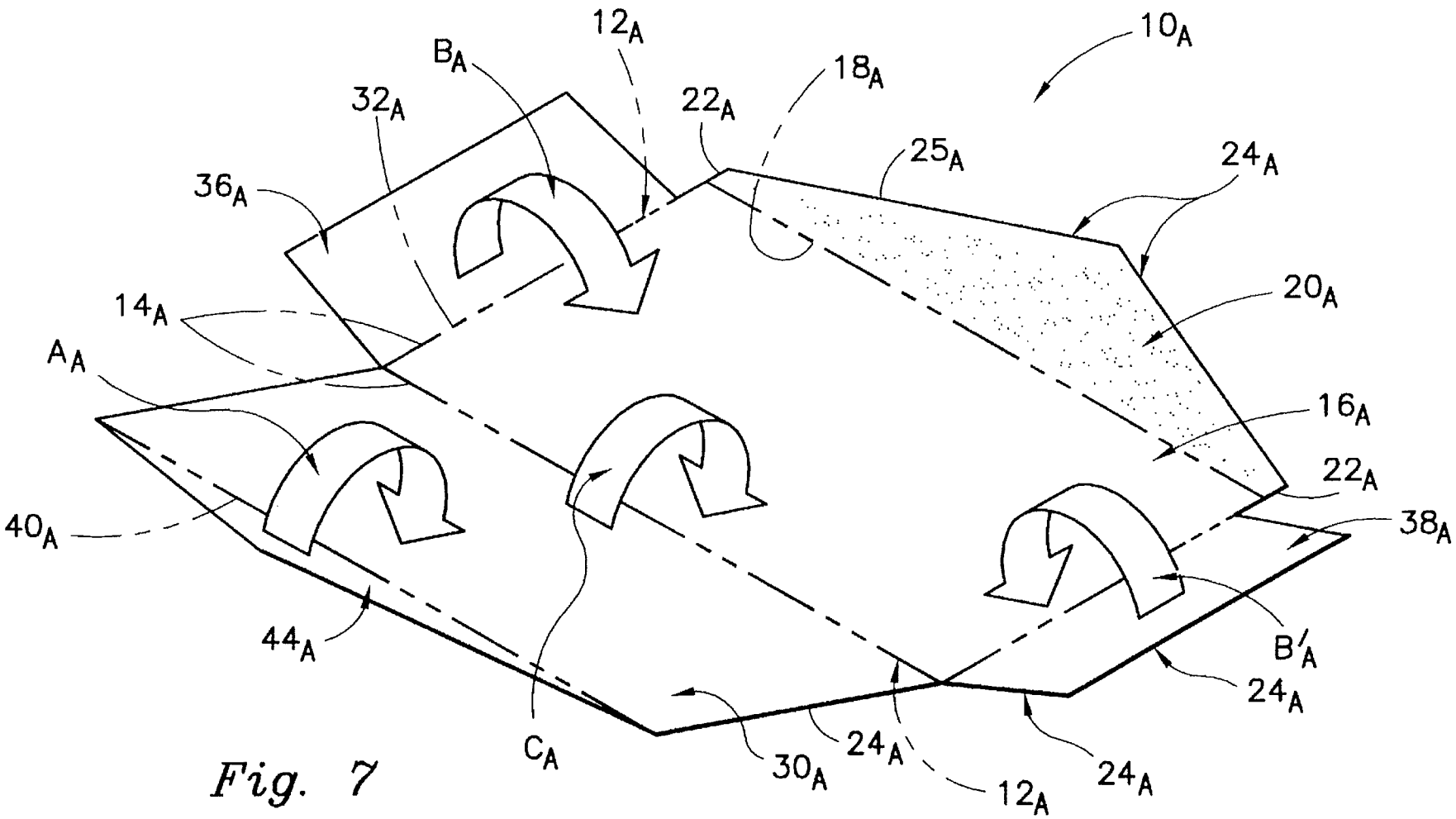
FIG. 7 is a schematic isometric view showing the blank illustrated in FIG. 6 being folded, in the process of forming an envelope according to the second embodiment of the invention.
Figure 8:
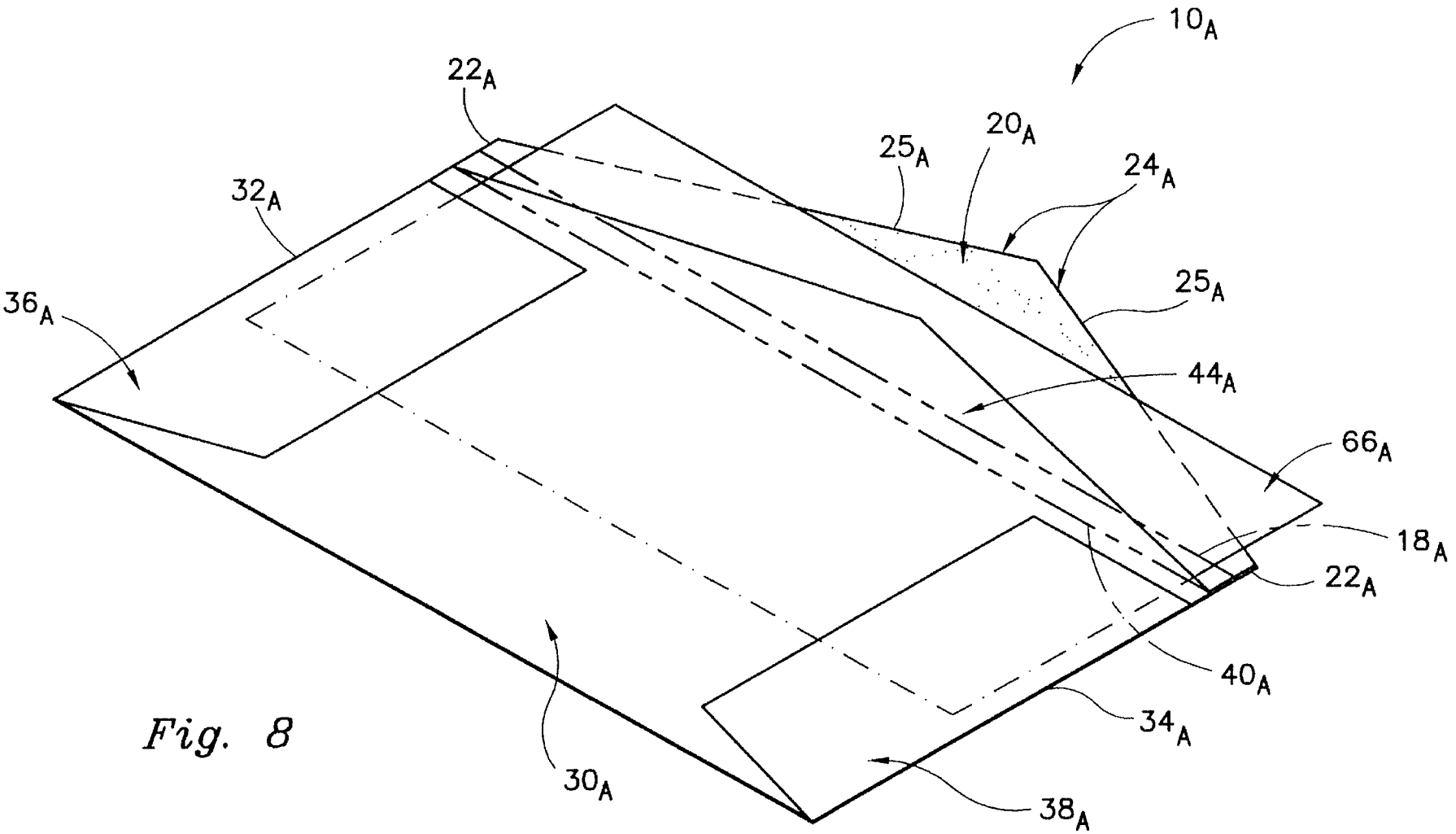
FIG. 8 is a view similar to FIG. 7 showing the blank further folded relative to FIGS. 6 and 7 in the process of forming an envelope according to the second embodiment of the invention.
Figure 9:
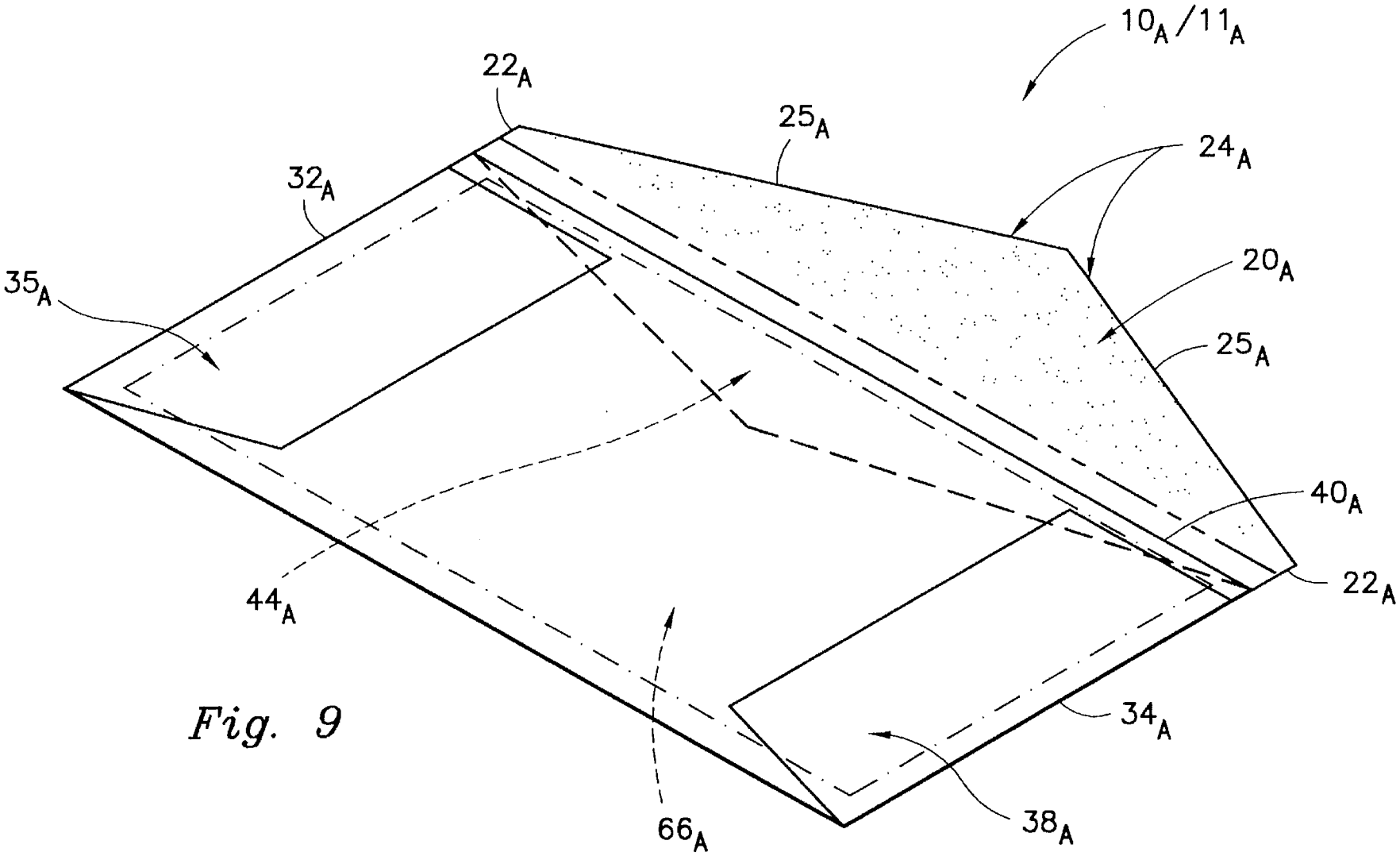
FIG. 9 is a view similar to FIGS. 7 and 8, showing the safety flap having been folded relative to the position illustrated in FIG. 8 in the process of forming an envelope according to the second embodiment of the invention, with the envelope ready for final sealing and a paper sheet contained within the envelope.

The preferred folding procedure applied to foldable blank $10_A$ to produce a second embodiment of an envelope $11_A$ embodying aspects of the invention is manifest from FIGS. 7, 8 and 9, illustrating blank $10_A$ being folded to form envelope $11_A$ according to the invention.

From FIGS. 7 and 8 especially, it is apparent that first and second trapezoidal portions $36_A$, $38_A$ are respectively foldable, and are so-folded, along third and fourth scores $32_A$, $34_A$ to form a rectangular back $48_A$ of envelope $11_A$ which is preferably substantially congruent with central portion $16_A$ forming a front of envelope $11_A$.

It is similarly apparent from FIGS. 7 through 9 that first triangular portion $20_A$ of foldable blank $10_A$ is foldable, and is so-folded, along first score $18_A$, which separates central rectangular portion $16_A$ from first triangular portion $20_A$, to form a closure flap $50_A$ of envelope $11_A$. It is yet further apparent from FIGS. 7 through 9 that second and third triangular portions $44_A$, $46_A$ of blank $10_A$ are respectively foldable, and are so-folded, along fifth and sixth scores $40_A$, $42_A$ to overlap first and second trapezoidal portions $36_A$, $38_A$ respectively and thereby form respective portions of a triangular safety flap $52_A$ which is under closure flap $50_A$ when first and second trapezoidal portions $36_A$, $38_A$ are convergingly folded along third and fourth scores $32_A$, $34_A$ to form envelope back $48_A$.

As is yet further apparent from FIGS. 7 through 9, second generally rectangular portion $30_A$ of blank $10_A$ is foldable, and is so-folded, along second score $28_A$ to form envelope back $48_A$ and overlap first and second trapezoidal portions $36_A$, $38_A$. This provides a closed envelope bottom $54_A$. First and second generally trapezoidal portions $36_A$, $38_A$ are preferably respectively folded along third and fourth scores $32_A$, $34_A$ convergingly towards central rectangular portion $16_A$ prior to second rectangular portion $30_A$ being convergingly folded along second score $28_A$ towards central rectangular portion $16_A$ to form envelope back $48_A$ which is preferably of rectangular configuration.

Figure 10:
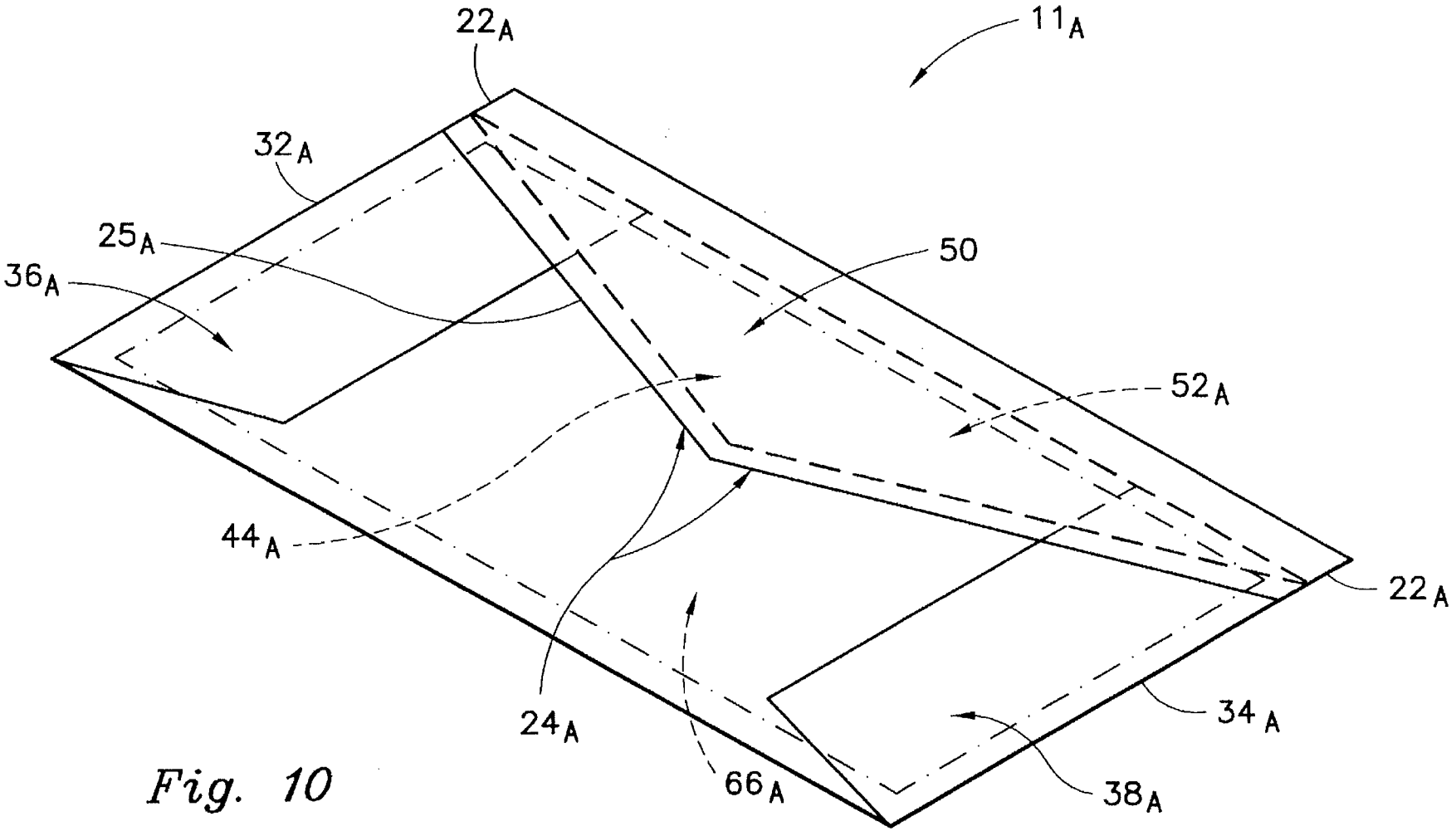
FIG. 10 is a view similar to FIGS. 7, 8 and 9 showing the blank folded to form an envelope according to the second embodiment of the invention, with the envelope containing a paper sheet and sealed for transmittal.

Second triangular portion $44_A$ may be folded convergingly towards second rectangular portion $30_A$ along fifth score $40_A$ to form an envelope safety flap $52_A$ illustrated in FIGS. 8, 9 and 10. The timing of the folding of second triangular portion $44_A$ convergingly toward second rectangular portion $30_A$ along score $40_A$ is optional with the envelope fabricator. Second triangular portion $44_A$ may be folded prior to the envelope being formed from blank $10_A$. Alternatively, the fabricator may wait until envelope $11_A$ has been fully formed and then may fold second triangular portion $44_A$ into the envelope interior. When this folding sequence is utilized, the safety flap remains outside of the envelope, as illustrated generally in FIG. 8, until a user of the envelope elects to fold second triangular portion $44_A$ inwardly to protect the envelope contents.

Unlike the embodiment of the envelope blank illustrated in FIGS. 1 through 5, blank $10_A$ is preferably cut with horizontal dimensions (which have not been designated using alphanumeric characters, but which correspond to dimensions AA and AA' in FIG. 3) of respective first and second trapezoidal portions $36_A$, $38_A$ so that no overlap results—most preferably first trapezoidal portion $36_A$ does not overlap any portion of second trapezoidal portion $38_A$. This is clearly shown in FIGS. 8, 9 and 10.

Figure 11:
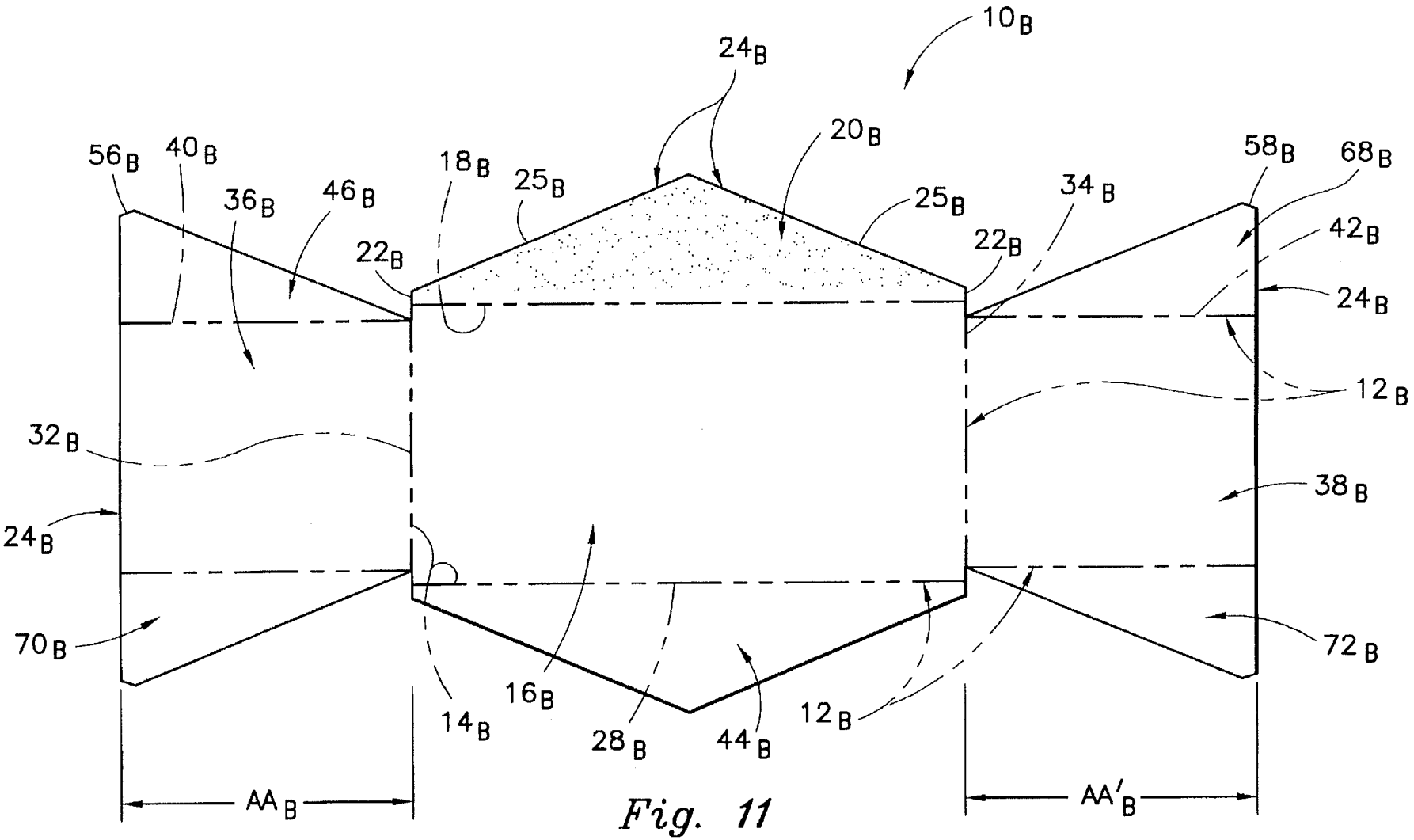
FIG. 11 is a plan view of a blank suitable for use in forming a third embodiment of an envelope in accordance with the invention; the blank illustrated in FIG. 11, the envelope formed therefrom and the method for forming such envelope all manifest aspects of the invention in its preferred third embodiment.

A foldable blank for forming a third embodiment of an envelope $11_B$ embodying aspects of the invention is illustrated in FIG. 11 and designated generally $10_B$. Blank $10_B$ is bounded by edges designated generally $24_B$. Foldable blank $10_B$ has scores, which are preferably linear, of reduced strength formed therein to facilitate folding of blank $10_B$ along these scores. The scores are designated generally $12_B$ in FIG. 11. Adjacent ones of scores $12_B$ are preferably transverse to one another. Scores designated generally $12_B$ are schematically illustrated by a line consisting of long segments separated by two short segments.

Scores $12_B$ are preferably formed by application of rollers, blades or some other relatively hard and relatively firm, optionally pointed, implement to the blank. Preferably scores $12_B$ are formed in blank $10_B$ on a continuous and especially a production line basis by suitable scoring rollers. Similarly, blank $10_B$ is preferably cut on a production line basis by suitable cutting rollers or other implements.

Some of scores $12_B$ define a rectangular boundary, designated generally $14_B$ in FIG. 11, of a central rectangular portion $16_B$ of the material sheet from which blank $10_B$ is formed. Central rectangular portion $16_B$ of blank $10_B$ forms a front of the envelope when blank $10_B$ has been folded into envelope $11_B$. Scores $12_B$ may be on either side or on both sides of blank $10_B$ so long as a line or area of reduced strength, along which blank $10_B$ can be folded, is formed in blank $10_B$ for each indicated one of scores $12_B$.

A first one of scores $12_B$, designated $18_B$ in FIG. 11, also defines a boundary of a first triangular portion $20_B$ of blank $10_B$ which adjoins central rectangular portion $16_B$. First triangular portion $20_B$ is preferably in the form of substantially an isosceles triangle. First triangular portion $20_B$ is generally referred to herein as being generally "triangular", notwithstanding presence of edge portions $22_B$ which are generally substantially perpendicular to first score $18_B$ and connect specific ones of edges $24_B$ of blank $10_B$, specifically edges $25_B$ of triangular portion $20_B$, with first score $18_B$. Edge portions $22_B$ are of substantially less length than are edges $25_B$ with which respective edge portions $22_B$ intersect.

The shapes of the parts of the blank $10_B$ used to form envelope $11_B$ as described herein, e.g. triangles and rectangles, while preferred, are not required. Also, the "front" and "back" of the envelope can be reversed from the configurations illustrated in the drawings.

In FIGS. 11 through 14, shading on triangular portion $20_B$ denotes adhesive. This adhesive is preferably of the type that when moistened and the portion of the envelope blank bearing the adhesive is pressed against a second portion of the envelope blank as the portion bearing such adhesive is convergingly folded to facingly contact the second portion, the two portions of the blank are secured together once the adhesive dries.

A second score $28_B$ is preferably generally parallel with first score $18_B$ and additionally defines a boundary of a second generally triangular portion $44_B$ of blank $10_B$ which adjoins central rectangular portion $16_B$ along the length of second score $28_B$.

Third and fourth scores which are respectively designated $32_B$ and $34_B$ in FIG. 11 are spaced from one another, extend between first and second scores $18_B$, $28_B$ and respectively define inboard boundaries of respective second and third generally rectangular portions $36_B$, $38_B$ of blank $10_B$, where rectangular portions $36_B$, $38_B$ join central portion $16_B$.

Still referring to FIG. 11, parallel fifth and sixth scores $40_B$, $42_B$ extend transversely respectively from third score $32_B$ and fourth score $34_B$ in directions parallel with first and second scores $18_B$, $28_B$ to respectively define additional boundaries of second and third generally rectangular portions $36_B$, $38_B$ of blank $10_B$, and further to respectively define inboard boundaries of respective third and fourth triangular portions $46_B$, $68_B$ of blank $10_B$.

Figure 12:
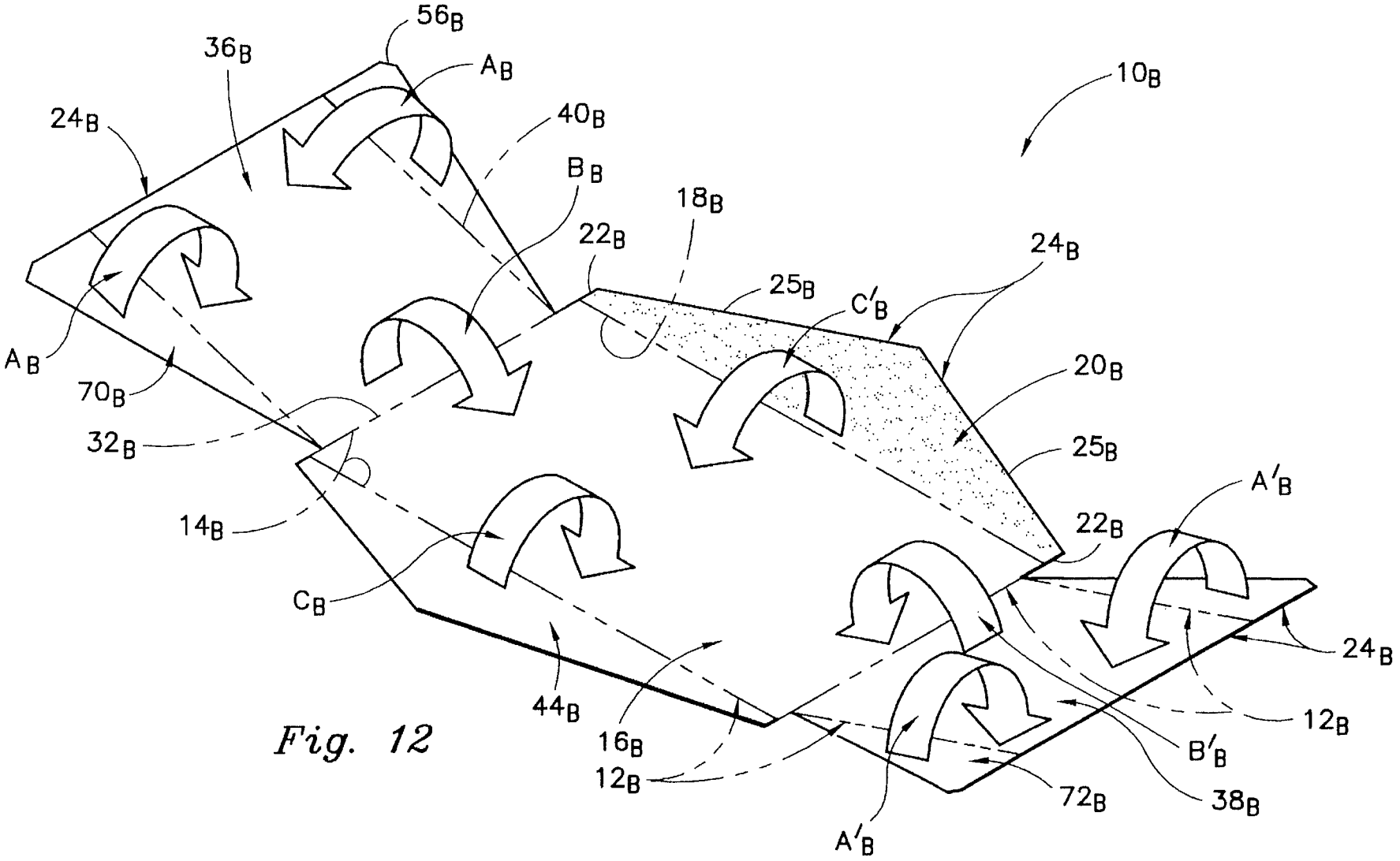
FIG. 12 is a schematic isometric view showing the blank illustrated in FIG. 11 being folded, in the process of forming an envelope according to the third embodiment of the invention.
Figure 13:
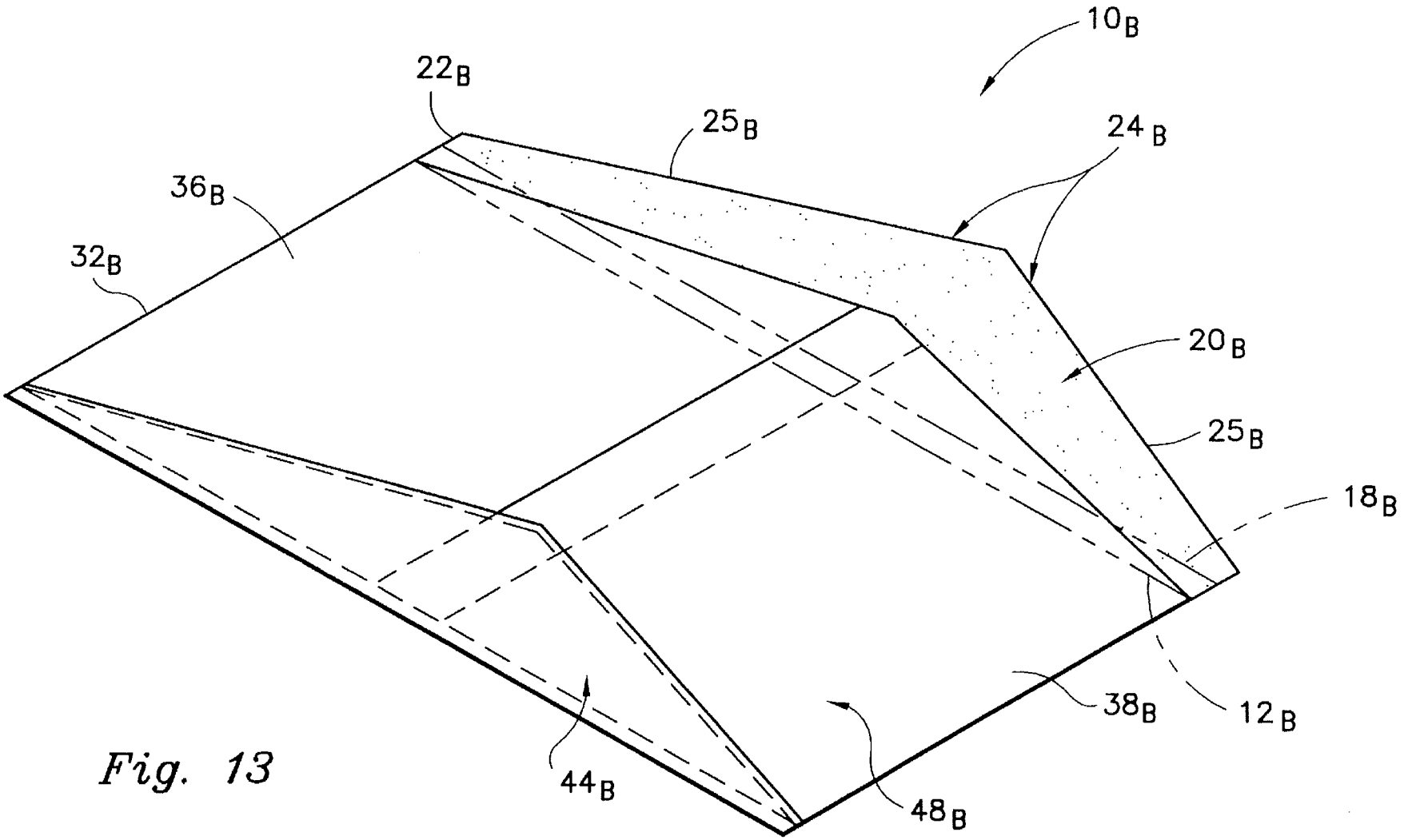
FIG. 13 is a view similar to FIG. 12 showing the blank further folded relative to FIGS. 11 and 12 in the process of forming an envelope according to the third embodiment of the invention.
Figure 14:
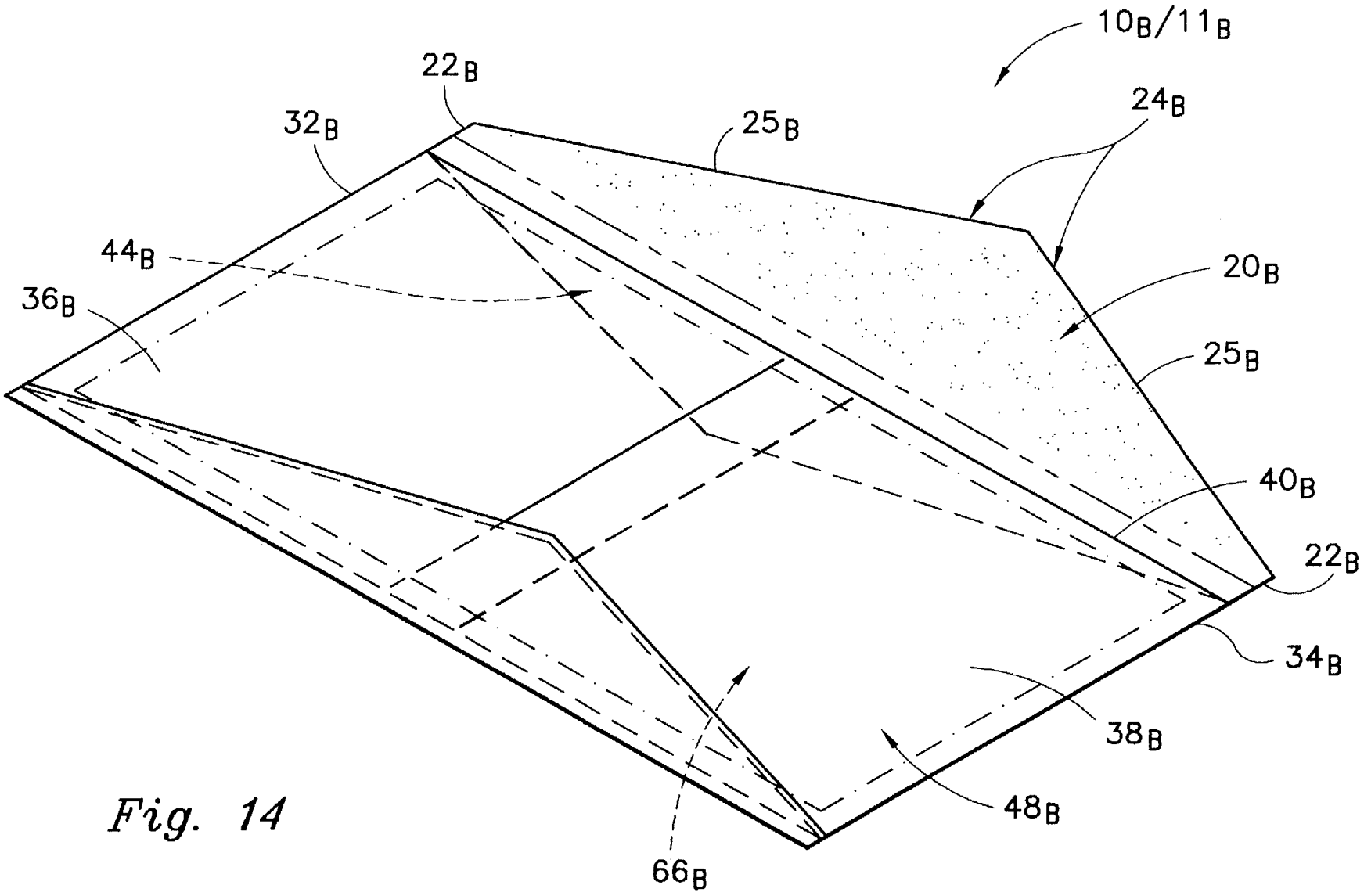
FIG. 14 is a view similar to FIGS. 12 and 13, showing the safety flap having been folded relative to the position illustrated in FIG. 13 in the process of forming an envelope according to the third embodiment of the invention, with the envelope ready for final sealing and a paper sheet within the envelope.

The folding procedure applied to foldable blank $10_B$ to produce a third embodiment of an envelope $11_B$ embodying aspects of the invention is manifest from FIGS. 12, 13 and 14, illustrating blank $10_B$ being folded to form envelope $11_B$ according to the invention.

From FIGS. 12 and 13 especially, it is apparent that the second and third rectangular portions $36_B$, $38_B$ are respectively foldable, and are so-folded, along third and fourth scores $32_B$, $34_B$ to form a rectangular back $48_B$ of envelope $11_B$ which is preferably substantially congruent with central portion $16_B$ forming a front of envelope $11_B$.

It is similarly apparent from FIGS. 12 through 14 that first triangular portion $20_B$ of foldable blank $10_B$ is foldable, and is so-folded, along first score $18_B$, which separates central rectangular portion $16_B$ from first triangular portion $20_B$, to form a closure flap 50 of envelope $11_B$. It is yet further apparent from FIGS. 12 through 14 that third and fourth triangular portions $46_B$, $68_B$ of blank $10_B$ are respectively foldable, and are so-folded, along fifth and sixth scores $40_B$, $42_B$ to overlap second and third rectangular portions $36_B$, $38_B$ respectively and thereby form respective portions of a first triangular safety flap $52_B$ which is under closure flap $50_B$ when second and third rectangular portions $36_B$, $38_B$ are convergingly folded along third and fourth scores $32_B$, $34_B$ to form envelope back $48_B$.

As is yet further apparent from FIGS. 12 through 14, second generally triangular portion $44_B$ of blank $10_B$ is foldable, and is so-folded, along second score $28_B$ to partially overlap envelope back $48_B$ formed by second and third rectangular portions $36_B$, $38_B$. This provides a closed envelope bottom $54_B$ after second and third generally rectangular portions $36_B$, $38_B$ have been respectively folded along third and fourth scores $32_B$, $34_B$ to form envelope back $48_B$ which is preferably of rectangular configuration.

Respecting third and fourth triangular portions $46_B$, $68_B$ illustrated in FIG. 11, while these portions have been referred to as being "triangular" (in that these portions are substantially triangular in configuration and appearance), these portions actually have, and have been illustrated with, four sides. Specifically, short edges $56_B$, $58_B$ have been illustrated connecting numbered sides of respective second and third triangular portions $44_B$, $46_B$, where short edges $56_B$, $58_B$ represent an edge which has been cut to eliminate what would otherwise be two vertices or points on closure flap $50_B$ formed by second and third triangular portions $44_B$, $46_B$.

Figure 15:
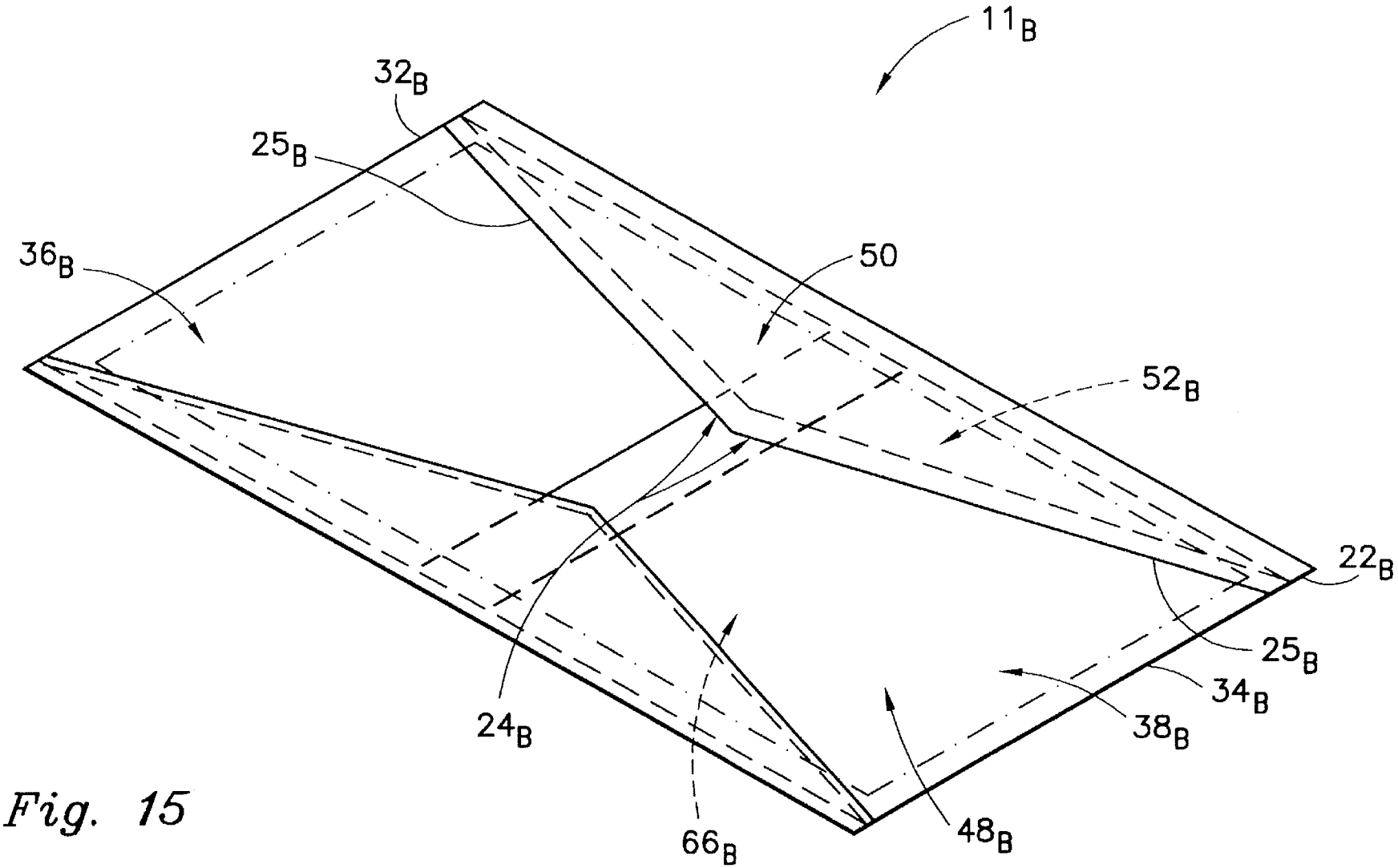
FIG. 15 is a view similar to FIGS. 12, 13 and 14 showing the blank folded to form an envelope according to the third embodiment of the invention, with the envelope containing a paper sheet and sealed for transmittal.

Blank $10_B$ is cut so that horizontal dimensions $AA_B$, $AA_B'$ of respective second and third rectangular portions $36_B$, $38_B$ are sufficient that overlap results—at least a part of second rectangular portion $36_B$ overlaps a part of third rectangular portion $38_B$; similarly a part of third triangular portion $46_B$ overlaps part of fourth triangular portion $68_B$. This overlap is clearly shown in FIGS. 13, 14, and 15 and is desirable to provide strength in resulting envelope $11_B$ by providing adequate surface area for application of adhesive, if desired, to retain in bonded together disposition the overlapping strips (which have not been numbered in FIGS. 13, 14 and 15) of second and third rectangular portions $36_B$, $38_B$ and third and fourth triangular portions $46_B$, $68_B$.

Dimensions $AA_B$ and $AA_B'$ may be equal, but this is not required.

Short edges $56_B$, $58_B$ are provided as parts of the boundaries of third and fourth triangular portions $46_B$, $68_B$. With this configuration so that when second and third rectangular portions $36_B$, $38_B$ are folded convergingly (respecting central rectangular portion $16_B$) to provide overlap of a strip of second rectangular portion $36_B$ and adjoining third triangular portion $46_B$ with counterpart strips of third rectangular portion $38_B$ and adjoining fourth triangular portion $68_B$, a vertex $60_B$ results at the juncture of respective short edges $56_B$, $58_B$. Vertex $60_B$ results where those edges overlap respective longer outboard edges $62_B$, $64_B$ of respective counterpart triangular portions $44_B$ and $46_B$ respectively.

Figure 16:
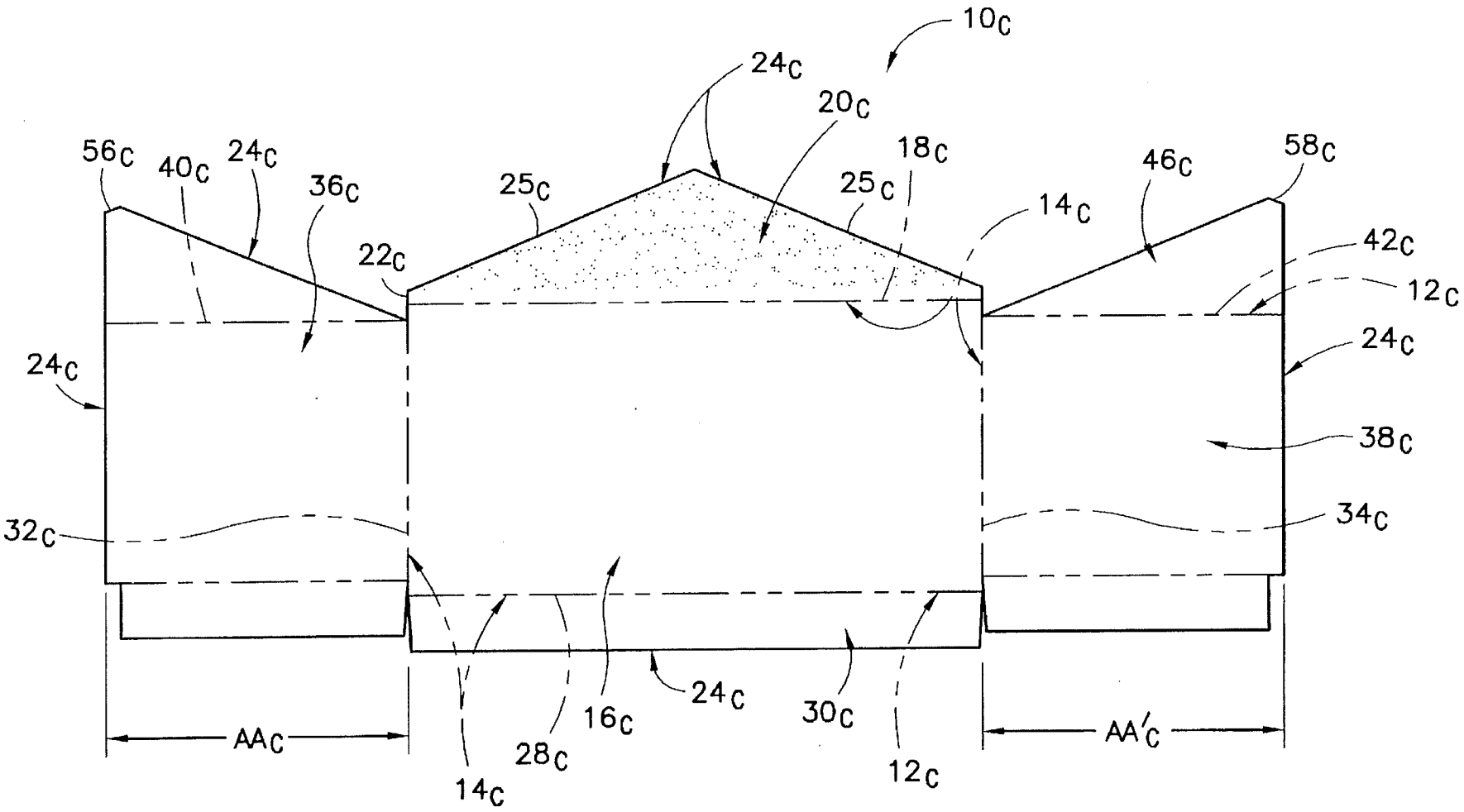
FIG. 16 is a plan view of a blank suitable for use in forming a fourth embodiment of an envelope in accordance with the invention; the blank illustrated in FIG. 16, the envelope formed therefrom and the method for forming such envelope all manifest aspects of the invention in its preferred fourth embodiment.

A foldable blank for forming a fourth embodiment of an envelope $11_C$ embodying aspects of the invention is illustrated in FIG. 16 and designated generally $10_C$. Blank $10_C$ is bounded by edges designated generally $24_C$. Foldable blank $10_C$ has scores, which are preferably linear, of reduced strength formed therein to facilitate folding of blank $10_C$ along these scores. The scores are designated generally $12_C$ in FIG. 16. Adjacent ones of scores $12_C$ are preferably transverse to one another. Scores designated generally $12_C$ are schematically illustrated by a line consisting of long segments separated by two short segments.

Scores $12_C$ are preferably formed by application of rollers, blades or some other relatively hard and relatively firm, optionally pointed, implement to the blank. Preferably scores $12_C$ are formed in blank $10_C$ on a continuous and especially a production line basis by suitable scoring rollers. Similarly, blank $10_C$ is preferably cut on a production line basis by suitable cutting rollers or other implements.

Some of scores $12_C$ define a rectangular boundary, designated generally $14_C$ in FIG. 16, of a central rectangular portion $16_C$ of the material sheet from which blank $10_C$ is formed. Central rectangular portion $16_C$ of blank $10_C$ forms a front of the envelope when blank $10_C$ has been folded into envelope $11_C$. Scores $12_C$ may be on either side or on both sides of blank $10_C$ so long as a line or area of reduced strength, along which blank $10_C$ can be folded, is formed in blank $10_C$ for each indicated one of scores $12_C$.

A first one of scores $12_C$, designated $18_C$ in FIG. 16, also defines a boundary of a first triangular portion $20_C$ of blank $10_C$ which adjoins central rectangular portion $16_C$. First triangular portion $20_C$ is preferably in the form of substantially an isosceles triangle. First triangular portion $20_C$ is generally referred to herein as being "triangular", notwithstanding presence of edge portions $22_C$ which are generally substantially perpendicular to first score $18_C$ and connect specific ones of edges $24_C$ of blank $10_C$, specifically edges $25_C$ of triangular portion $20_C$, with first score $18_C$. Edge portions $22_C$ are of substantially less length than are edges $25_C$ with which respective edge portions $22_C$ intersect.

The shapes of the parts of the blank $10_C$ used to form envelope $11_C$ as described herein, e.g. triangles and rectangles, while preferred, are not required. Also, the "front" and "back" of the envelope can be reversed from the configurations illustrated in the drawings.

In FIGS. 16 through 19, shading on triangular portion $20_C$ denotes adhesive. This adhesive is preferably of the type that when moistened and the portion of the envelope blank bearing the adhesive is pressed against a second portion of the envelope blank as the portion bearing such adhesive is convergingly folded to facingly contact the second portion, the two portions of the blank are secured together once the adhesive dries.

A second score $28_C$ is preferably generally parallel with first score $18_C$ and additionally defines a boundary of a second generally rectangular portion $30_C$ of blank $10_C$ which adjoins central rectangular portion $16_C$ along the length of second score $28_C$.

Third and fourth scores which are respectively designated $32_C$ and $34_C$ in FIG. 16 are spaced from one another, extend between first and second scores $18_C$, $28_C$ and respectively define inboard boundaries of respective third and fourth generally rectangular portions $36_C$, $38_C$ of blank $10_C$, where rectangular portions $36_C$, $38_C$ join central portion $16_C$.

Still referring to FIG. 16, parallel fifth and sixth scores $40_C$, $42_C$ extend transversely respectively from third score $32_C$ and fourth score $34_C$ in directions parallel with first and second scores $18_C$, $28_C$ to respectively define additional boundaries of third and fourth generally rectangular portions $36_C$, $38_C$ of blank $10_C$, and further to respectively define inboard boundaries of respective second and third triangular portions $44_C$, $46_C$ of blank $10_C$.

Figure 17:
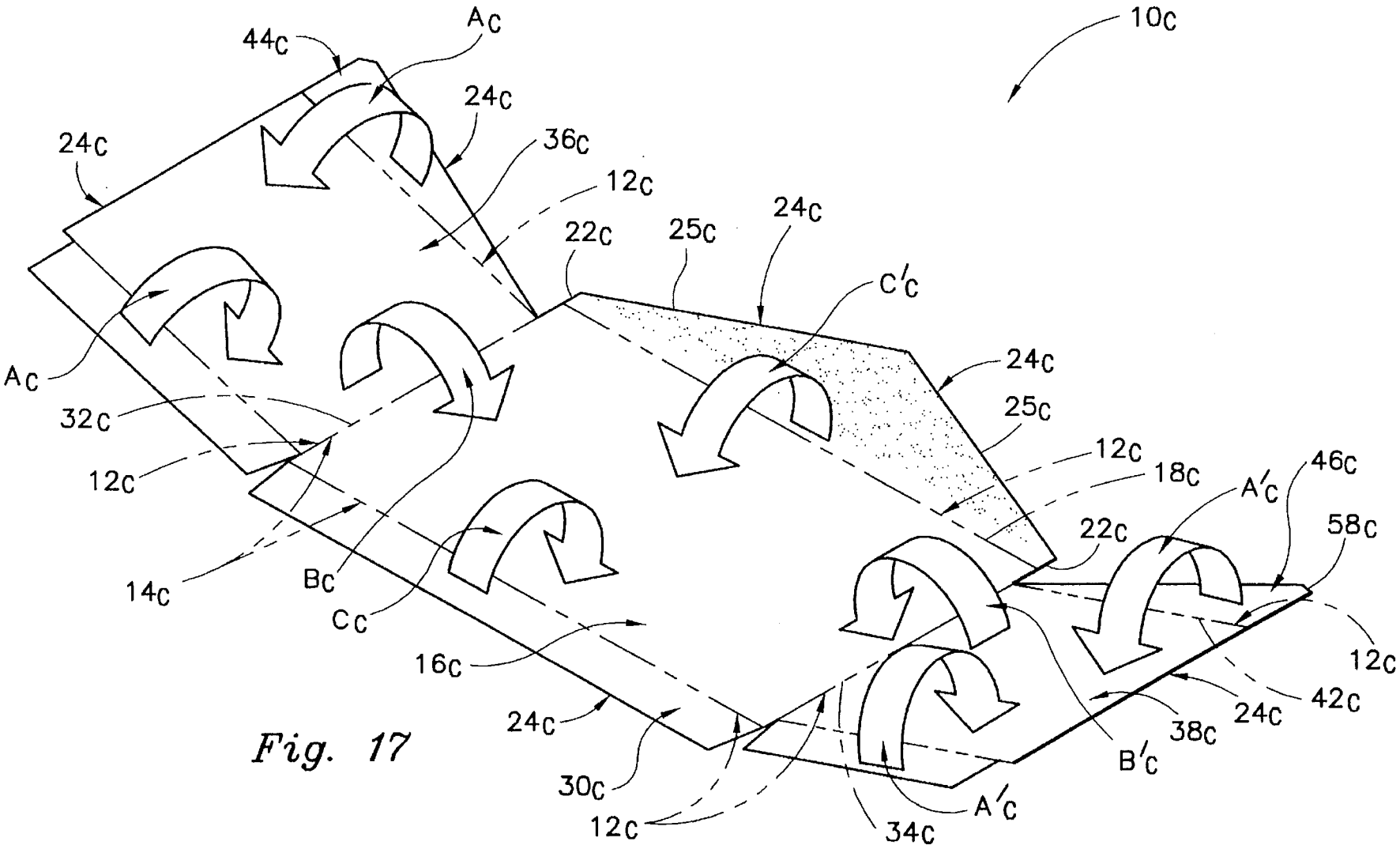
FIG. 17 is a schematic isometric view showing the blank illustrated in FIG. 16 being folded, in the process of forming an envelope according to the fourth embodiment of the invention.
Figure 18:
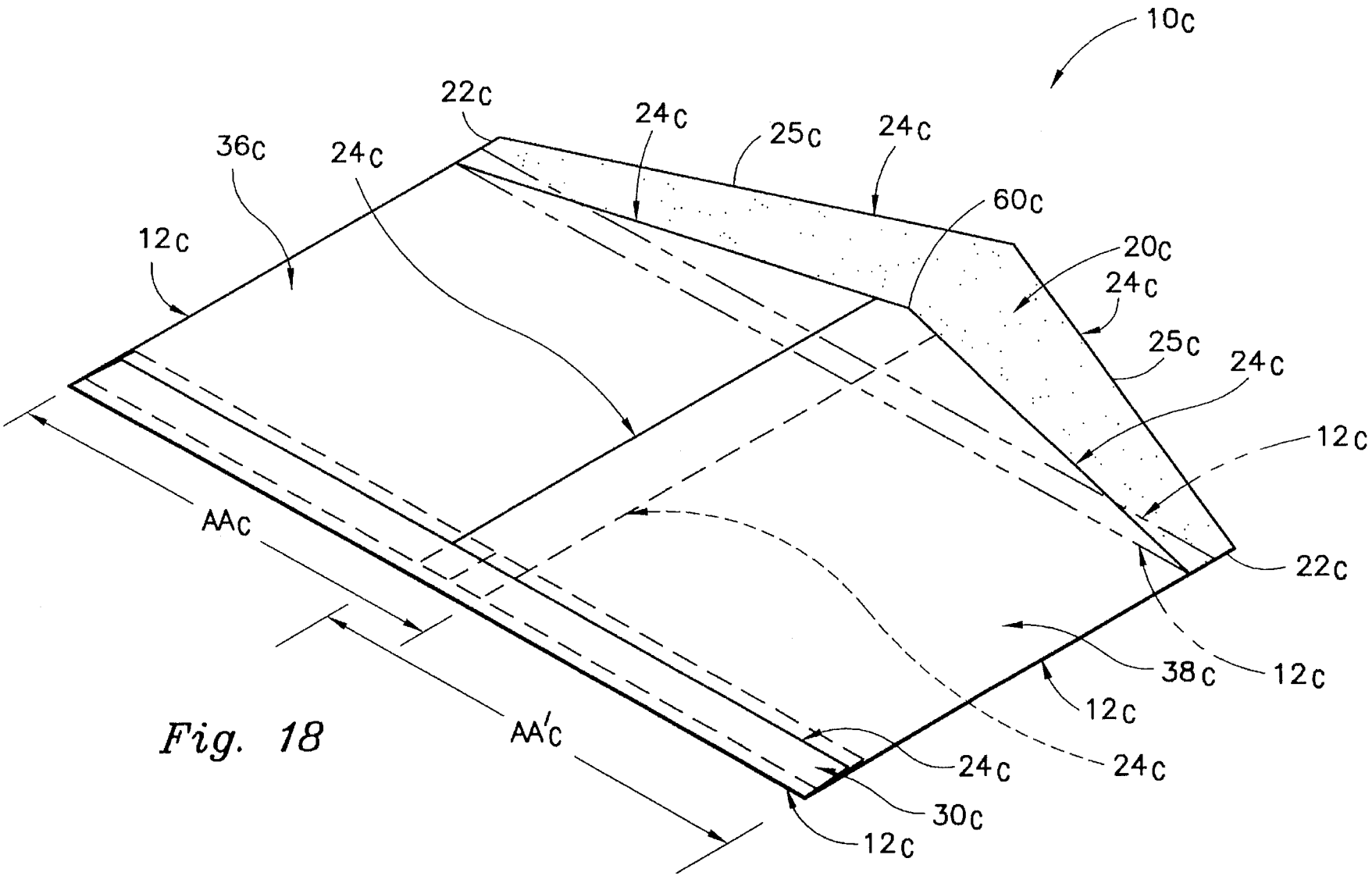
FIG. 18 is a view similar to FIG. 17 showing the blank further folded relative to FIGS. 16 and 17 in the process of forming an envelope according to the fourth embodiment of the invention.
Figure 19:
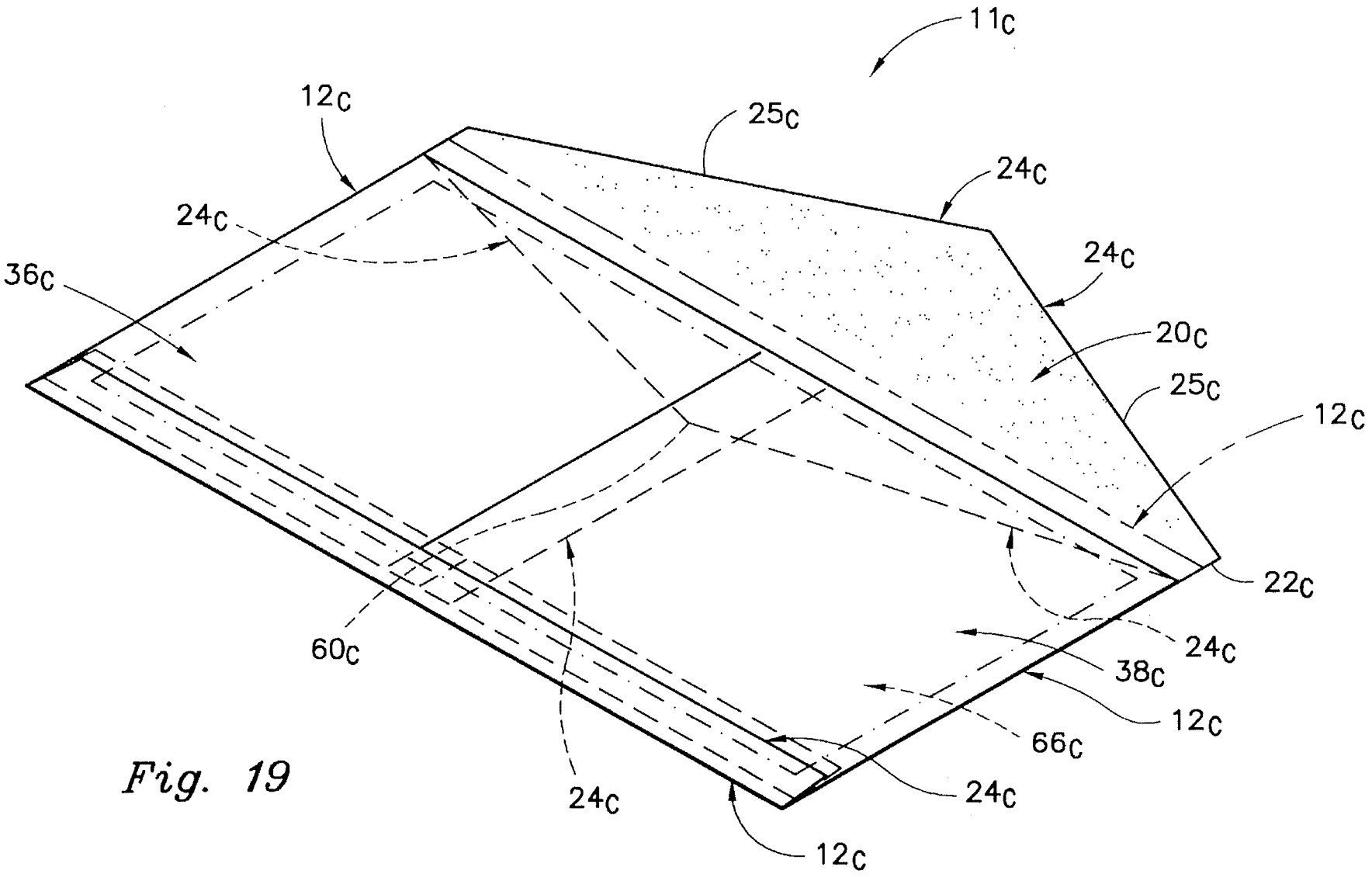
FIG. 19 is a view similar to FIGS. 17 and 18, showing the safety flap having been folded relative to the position illustrated in FIG. 18 in the process of forming an envelope according to the fourth embodiment of the invention, with the envelope ready for final sealing and a paper sheet within the envelope.

The folding procedure applied to foldable blank $10_C$ to produce a fourth embodiment of an envelope $11_C$ embodying aspects of the invention is manifest from FIGS. 17, 18 and 19, illustrating blank $10_C$ being folded to form envelope $11_C$ according to the invention.

From FIGS. 17 and 18 especially, it is apparent that third and fourth rectangular portions $36_C$, $38_C$ are respectively foldable, and are so-folded, along third and fourth scores $32_C$, $34_C$ to form a rectangular back $48_C$ of envelope $11_C$ which is preferably substantially congruent with central portion $16_C$ forming a front of envelope $11_C$.

It is similarly apparent from FIGS. 17 through 19 that first triangular portion $20_C$ of foldable blank $10_C$ is foldable, and is so-folded, along first score $18_C$, which separates central rectangular portion $16_C$ from first triangular portion $20_C$, to form a closure flap $50_C$ of envelope $11_C$. It is yet further apparent from FIGS. 17 through 19 that second and third triangular portions $44_C$, $46_C$ of blank $10_C$ are respectively foldable, and are so-folded, along fifth and sixth scores $40_C$, $42_C$ to overlap third and fourth rectangular portions $36_C$, $38_C$ respectively and thereby form respective portions of a triangular safety flap $52_C$ which is under closure flap $50_C$ when third and fourth rectangular portions $36_C$, $38_C$ are convergingly folded along third and fourth scores $32_C$, $34_C$ to form envelope back $48_C$.

As is yet further apparent from FIGS. 17 through 19, second generally rectangular portion $30_C$ of blank $10_C$ is foldable, and is so-folded, along second score $28_C$ to partially overlap envelope back $48_C$ formed by third and fourth rectangular portions $36_C$, $38_C$. This provides a closed envelope bottom $54_C$ after third and fourth generally rectangular portions $36_C$, $38_C$ have been respectively folded along third and fourth scores $32_C$, $34_C$ to form envelope back $48_C$ which is preferably of rectangular configuration.

Respecting second and third triangular portions $44_C$, $46_C$ illustrated in FIG. 16, while these portions have been referred to as being "triangular" (in that these portions are substantially triangular in configuration and appearance), these portions actually have, and have been illustrated with, four sides. Specifically, short edges $56_C$, $58_C$ have been illustrated connecting numbered sides of respective second and third triangular portions $44_C$, $46_C$, where short edges $56_C$, $58_C$ represent an edge which has been cut to eliminate what would otherwise be two vertices or points on closure flap $50_C$ formed by second and third triangular portions $44_C$, $46_C$.

Figure 20:
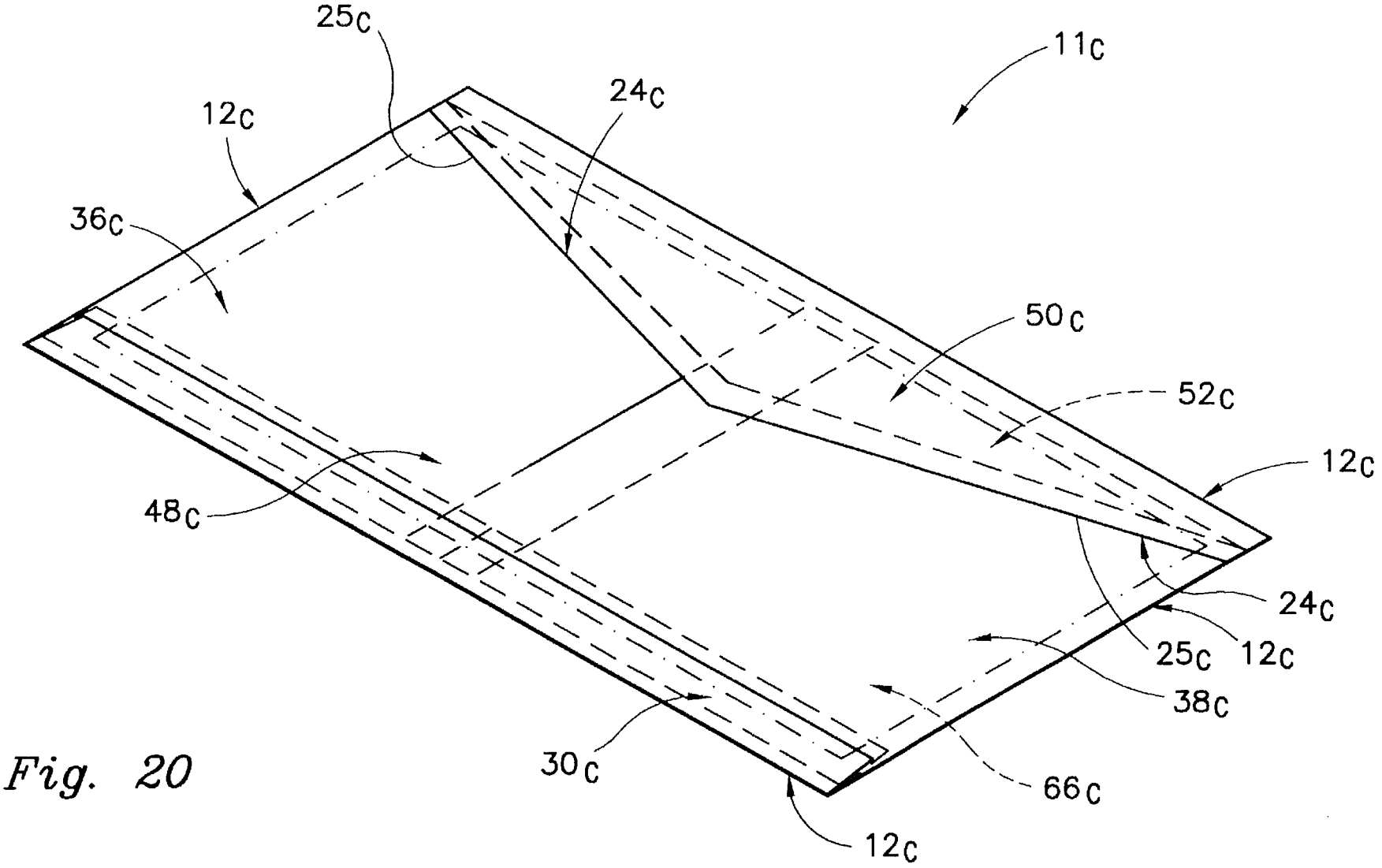
FIG. 20 is a view similar to FIGS. 17, 18 and 19 showing the blank folded to form an envelope according to the fourth embodiment of the invention, with the envelope containing a paper sheet and sealed for transmittal.

Blank $10_C$ is cut so that horizontal dimensions $AA_C$, $AA_C'$ of respective third and fourth rectangular portions $36_C$, $38_C$ are sufficient that overlap results—at least a part of third rectangular portion $36_C$ overlaps a part of fourth rectangular portion $38_C$; similarly a part of second triangular portion $44_C$ overlaps third triangular portion $46_C$. This overlap is clearly shown in FIGS. 18, 19 and 20 and is desirable to provide strength in resulting envelope $11_C$. The strength characteristic results from provision of adequate surface area for application of adhesive, if desired, to retain in bonded together disposition the overlapping strips (which have not been numbered in FIGS. 18, 19 and 20) of third and fourth rectangular portions $36_C$, $38_C$ and second and third triangular portions $44_C$, $46_C$.

Dimensions $AA_C$ and $AA_C'$ may be equal, but this is not required.

Short edges $56_C$, $58_C$ are provided as parts of the boundaries of second and third triangular portions $44_C$, $46_C$ so that when third and fourth rectangular portions $36_C$, $38_C$ are folded convergingly (respecting central rectangular portion $16_C$) to provide overlap of a strip of third rectangular portion $36_C$ and adjoining second triangular portion $44_C$ with a counterpart strip of fourth rectangular portion $38_C$ and adjoining third triangular portion $46_C$, a vertex $60_C$ results. Vertex $60_C$ is at the juncture of respective short edges $56_C$, $58_C$, where those edges overlap respective longer outboard edges $62_C$, $64_C$ of respective counterpart triangular portions $44_C$ and $46_C$ respectively.

In accordance with features of this invention as shown in FIG. 1, left and right flap panels 36, 38 extend vertically of the main body 16. The left and right flap panels are hingedly connected to the main body along left and right side score lines 32, 34. The left and right flap panels are folded rightward and leftward, respectively, as shown in FIG. 2, into juxtaposition with the main body and attached together to form the back side of the envelope, as shown in FIG. 3.

The left flap panel 36 is also bounded by an upper score line 40 and two cut edges 38, 40 which are parallel respectively to score lines 32 and 34. The right side flap panel 38 is also bounded by an upper score line 42 and two cut edges 44, 46 which are parallel respectively to score lines 32 and 34.

The left flap panel has a flap portion 44 of predetermined height and width, extending horizontally of and substantially co-extensive with the left flap panel 36 and hingedly connected to the left flap panel body 36 along the score line 40. The right flap panel has a similarly placed flap portion 46 of the same dimensions as flap portion 44. When the left and right side flap panels are attached together, the flap portions form a safety flap 52, as shown in FIG. 5.

The safety flap 52 extends horizontally of and substantially co-extensively with the upper score lines 40, 42 of the attached left and right flap. The score lines of the attached flaps are substantially the same length as the length of the score line 18 and are parallel to and below score line 18 when the envelope has been formed.

As is apparent from the drawings and the foregoing text, the right and left flap panels may take various forms and variations in the present invention, some of which will be more particularly described hereinafter. Their cooperation with other elements of the blank and the envelope formed from the blank imparts to the present invention distinctive characteristics. The safety flap formed as a result of the attachment of the flap panels is contemplated as serving the function of protecting materials, which have been inserted into the envelope, during the envelope opening procedure. The safety flap is also expected to be used in the course of mailing such materials and during storage and use of the materials after an initial opening of the envelope.

In order to accommodate mailing and subsequent reuse of the envelope to be formed from the blank, the blank 10 has a closure flap 50 of predetermined width. The closure flap 50 extends horizontally of and substantially co-extensively with the main body 16 and is hingedly connected to the adjacent body portion along horizontal score line 18. The closure flap 50 is preferably triangular in configuration but may be trapezoidal or rectangular or take other configurations.

The envelope may also have a bottom flap 30. Flap 30 extends horizontally co-extensively with said main body and is hingedly connected to an adjacent one of said body portions along the lower-most horizontally extending score line 28.

While described with reference to the blank illustrated in FIG. 1, certain of the features of this invention will become more clear from a discussion of the use of the blank as a folding envelope. This formation and folding of the envelope is illustrated by the sequence in FIGS. 2 through 5. The envelope thus produced has a capability of receiving loose materials such as brochures, fliers, printed sheets and the like within the pocket formed by the main body 16 which defines the envelope front and the attached right and left flaps 36, 38 which define the envelope back side. The material is retained during mailing by inserting the safety flap 52 into the envelope to hold the materials in place and attaching the closure flap 50 to the outer surface of the back portion 48 formed by the attachment of the left and right flaps as shown in FIG. 5.

The flap panels 36, 38 may be configured in a number of varying ways while realizing the advantages of this invention. One variation will have flap panels of predetermined width such that the width is greater than the width of the main body as illustrated in FIGS. 3–5. In such an envelope, the flap panels may be secured together such as by gluing, if desired, in order to provide even further enhanced security for materials contained within the envelope for mailing.

The configurations of the flaps may also be varied in order to impart preferred design features. If desired, stiffening sheets may be inserted into the pocket either to provide greater body to the finished envelope or to provide greater security in transmitting enclosures.

The envelope may be opened by cutting or tearing open the closure flap leaving the safety flap to protect the materials within the envelope during envelope opening. The envelope may then be reused for storage of the enclosed materials by reinserting the safety flap into the envelope to protect the materials during the envelope opening procedure and, ancillary, to hold the materials in place.

As will be appreciated by persons skilled in the printing arts, the folding envelope of this invention may be easily printed both on the surface of the main body and on the surface of the closure flap 50 during a single pass through a press. Further, the score lines may be similarly formed during continuous web handling of the material. The score lines may be adjusted as needed to accommodate a greater bulk of materials within the envelope.

A modified form of blank and envelope in accordance with the present invention is shown in FIGS. 11 through 15 where similar referenced characters to those used heretofore have been applied to similar elements. The discussion here given will be directed only to distinctions between the forms.

This form of the invention essentially comprises an envelope with safety flaps and closure flaps along both the upper and lower sides of the envelope. In this modified form, the blank has a second closure flap panel having dimensions similar to closure flap panel $\mathbf{50}_B$. The second closure flap panel extends horizontally of and substantially co-extensively with the main body and is hingedly connected to the adjacent body portion along the lower-most one of the horizontal score lines.

The left and right panel flaps each have a triangular portion extending co-extensively with each flap means and hingedly connected to the adjacent body portion of each flap means at lower score lines. The lower left and right triangular portions are similar in dimension to the upper left and right triangular portions $\mathbf{44}_B$, $\mathbf{46}_B$. Upon the attachment of a flap means $\mathbf{36}_B$, $\mathbf{38}_B$, the lower triangular portions form a lower holding flap similar to the upper safety flap.

Respecting choices of adhesive, the envelope may be fabricated with two different kinds of adhesive or using a single type of adhesive. Specifically, it may be desirable to have the envelope fabricated using one type of adhesive applied to the areas of overlap of the respective portions of the blank once the folds have been completed. In such case, it may be desirable to use a second adhesive preferably of the type which, when moistened, may secure an envelope closure flap to the remainder of the envelope. This second type of adhesive may be applied on the closure flap as indicated by stippling in the drawings.

Alternatively, the same type of adhesive may be used throughout. Most desirably, the adhesive is applied to the areas of overlap of the envelope blank when the blank is formed and the scores are created therein; this provides manufacturing efficiencies. Of course, the blank can be formed from a sheet of material already having adhesive applied thereto or impregnated therein or having been otherwise treated to provide the requisite adhesive property to retain the envelope in fabricated disposition once the blank has been cut, the scores have been formed, the folds have been made and the overlapping portions of the blank have been pressed together.

While the preferred embodiment of the invention has been described above and alternative embodiments have also been described, the scope of protection to which the invention is believed entitled is defined by the claims and by equivalents thereto which perform substantially the same function in substantially the same way to achieve substantially the same result as set forth in the claims, so long as such substantial equivalents, as defined by a claim for such substantial equivalent, do not read on the prior art.

What is claimed is:

1. A foldable blank for forming an envelope, comprising:

a. a material sheet having linear scores of reduced strength therein to facilitate folding of said sheet therealong;

b. adjacent ones of said scores being transverse to one another;

c. said scores defining a rectangular boundary of a central rectangular portion of said sheet forming a front of said envelope when folded;

d. a first one of said scores defining one boundary of a first triangular portion of said sheet adjoining said central portion;

e. a second score parallel with said first score defining one boundary of a second generally rectangular portion of said sheet adjoining said central portion;

f. third and fourth scores spaced from one another, extending between said first and second scores and respectively defining boundaries of respective third and fourth generally rectangular portions of said sheet adjoining said central portion;

g. parallel fifth and sixth scores extending respectively transversely from said third and fourth scores parallel with said first and second scores and defining additional boundaries of said third and fourth generally rectangular portions of said sheet and respective boundaries of respective second and third triangular portions of said sheet;

h. said third and fourth portions being respectively foldable along said third and fourth scores to form a rectangular back, substantially congruent with said front of said envelope;

i. said first triangular portion of said sheet being foldable along said first score separating said central portion from said first triangular portion to form a closure flap of said envelope;

j. said second and third triangular portions of said sheet being respectively foldable along said fifth and sixth scores to overlay said third and fourth rectangular portions and form respective portions of a triangular safety flap underlying said closure flap when said third and fourth rectangular portions are convergingly folded along said third and fourth scores to form said rectangular envelope back;

k. said second generally rectangular portion of said sheet being foldable along said second score to partially overlay said back of said envelope formed by said third and fourth rectangular portions and provide a closed bottom of said envelope after said third and fourth generally rectangular portions have been respectively folded along said third and fourth scores to form said rectangular back;

l. parallel seventh and eighth scores extending respectively transversely from said third and fourth scores parallel with said first and second scores and defining additional boundaries of said third and fourth generally rectangular portions of said sheet and respective boundaries of respective fifth and sixth rectangular portions of said sheet;

m. said second and third triangular portions of said sheet being respectively foldable along said fifth and sixth scores to overlay said third and fourth rectangular portions and form respective portions of a triangular safety flap underlying said closure flap when said third and fourth rectangular portions are folded along said third and fourth scores to form said rectangular back; and n. said fifth and sixth rectangular portions of said sheet being respectively foldable along said seventh and eighth scores to overlay said third and fourth rectangular portions and form respective portions of a rectangular safety flap underlying said second rectangular portion when said second rectangular portion has been folded along said third and fourth scores to form a closed bottom of said envelope.

2. A one-piece, imperforate envelope formed by folding a unitary blank entirely along straight lines, including a safety flap underlying and substantially congruent with an envelope closure flap, comprising:

a. a sheet having a central portion defining a rectangular front of said envelope and being bounded by scores in said sheet;

b. a triangular closure flap adjoining said central portion along a first one of said scores bounding said central portion, being convergingly foldable towards said central portion along said first score;

c. a second generally rectangular portion of said sheet adjoining said central portion along a second one of said scores parallel to and spaced from said first score, being convergingly foldable towards said central portion along said second score;

d. a back substantially congruent with said front, comprising:

i. two spaced-apart rectangular portions of said sheet connecting with said central portion along spaced-apart parallel third and fourth scores running transversely to said first and second scores, said rectangular portions convergingly folding respecting said central portion to overlay one another and form said back;

e. a triangular safety flap comprising:

i. second and third triangular portions of said sheet foldingly adjoining said third and fourth rectangular portions along said fifth and sixth scores to overlay said third and fourth rectangular portions when convergingly folded along said fifth and sixth scores towards said third and fourth portions;

f. said safety flap underlying said closure flap when, subsequent to folding of said first and second triangular portions, said third and fourth portions are convergingly folded along said third and fourth score to form said back thereby bringing together in overlying disposition said second and third triangular portions of said sheet to define said triangular safety flap;

g. said second rectangular portion being folded along said second score to overlay said back of said envelope and provide a closed envelope bottom after said third and fourth generally rectangular portions have been respectively folded along said third and fourth scores to form said back; and h. a rectangular safety flap underlying said rectangular closure flap and comprising fifth and sixth rectangular portions of said sheet foldingly adjoining said second rectangular portion along said seventh and eighth scores to overlay said third and fourth rectangular portions when convergingly folded along said seventh and eighth scores towards said first rectangular portion.

3. A method of foldably constructing a one-piece envelope including a safety flap at least partially congruent with and underlying an envelope closure flap, comprising:

a. cutting a sheet of imperforate material to preselected shape defining an envelope blank;

b. forming straight line scores of reduced strength in said blank to facilitate folding of said blank therealong, to define a rectangular boundary of a central portion of said blank forming a front of said envelope when folded, including the steps of:

i. forming a first one of said scores to define one leg of a boundary of a triangular closure flap adjoining said central portion along said first score bounding said central portion so that said triangular closure flap is convergingly foldable towards said central portion along said first score;

ii. forming a second one of said scores parallel with said first score to additionally define one boundary of a second generally rectangular portion outboard of said central portion to be foldable along said second score to overlay a back of said envelope and provide a closed envelope bottom;

iii. forming third and fourth ones of said scores spaced from one another to extend between said first and second scores and respectively additionally define boundaries of respective third and fourth generally rectangular portions outboard of said central portion to be convergingly foldable along said third and fourth scores towards said central portion to overlay said central portion and thereby form a back of said envelope;

iv. forming parallel fifth and sixth scores extending respectively from said third and fourth scores to define additional boundaries of said third and fourth generally rectangular portions and to additionally respectively define boundaries of respective second and third generally triangular portions to be respectively convergingly foldable towards said third and fourth rectangular portions along said fifth and sixth scores;

c. convergingly folding said second and third triangular portions of said sheet towards and respecting said respective third and fourth rectangular portions along said fifth and sixth scores to overlay said third and fourth rectangular portions to form an envelope safety flap underlying said closure flap when subsequent to folding of said second and third triangular portions said third and fourth portions are convergingly folded along said third and fourth score to form said back;

d. convergingly folding said third and fourth spaced-apart rectangular portions of said sheet respecting and connecting with said central portion along said spaced-apart parallel third and fourth scores running transversely to said first and second scores, to overlay one another and form a back of said envelope; and e. convergingly folding said second rectangular portion along said second score to overlay said back of said envelope and provide a closed envelope bottom after said third and fourth generally rectangular portions have been respectively folded along said third and fourth scores to form said back;

forming straight line scores of reduced strength in said blank to facilitate folding of said blank therealong, to define a rectangular boundary of a central portion of said blank forming a front of said envelope when folded, including:

i. forming parallel seventh and eighth scores extending respectively from said third and fourth scores to define additional boundaries of said third and fourth generally rectangular portions and boundary of fifth and sixth rectangular portions of said sheet foldingly adjoining said second rectangular portion along said seventh and eighth scores to overlay said third and fourth rectangular portions when convergingly folded along said seventh and eighth scores towards said first rectangular portion; and g. folding said fifth and sixth rectangular portions of said sheet towards and respecting said central rectangular portion along said seventh and eighth scores to overlay said third and fourth rectangular portions having been convergingly folded along said fifth and sixth scores, to form a rectangular envelope safety flap underlying said rectangular closure flap defining said closed envelope bottom.

* * * * *